US009783396B2

(12) United States Patent
Matsumoto

(10) Patent No.: US 9,783,396 B2
(45) Date of Patent: Oct. 10, 2017

(54) BOOM EXTENDING AND RETRACTING APPARATUS OF A CRANE

(71) Applicant: TADANO LTD., Kagawa (JP)

(72) Inventor: Naoyuki Matsumoto, Sanuki (JP)

(73) Assignee: TADANO LTD., Kagawa (JP)

( * ) Notice: Subject to any disclaimer, the term of this patent is extended or adjusted under 35 U.S.C. 154(b) by 257 days.

(21) Appl. No.: 14/549,154

(22) Filed: Nov. 20, 2014

(65) Prior Publication Data

US 2015/0144583 A1 May 28, 2015

(30) Foreign Application Priority Data

Nov. 26, 2013 (JP) ..... 2013-243984

(51) Int. Cl.
*B66C 23/70* (2006.01)
*B66F 9/22* (2006.01)

(52) U.S. Cl.
CPC ..... *B66C 23/705* (2013.01); *B66F 9/22* (2013.01)

(58) Field of Classification Search
CPC ..... B66C 23/705; B66F 9/22
See application file for complete search history.

(56) References Cited

U.S. PATENT DOCUMENTS

2006/0277905 A1 12/2006 Matsumoto

FOREIGN PATENT DOCUMENTS

| | | |
|---|---|---|
| EP | 1 666 735 A1 | 6/2006 |
| JP | H09-210005 A | 8/1997 |
| JP | B2-4040856 | 11/2008 |

OTHER PUBLICATIONS

Jun. 24, 2015 extended Search Report issued in European Patent Application No. 14194699.6.

*Primary Examiner* — Sang Kim
*Assistant Examiner* — Juan Campos, Jr.
(74) *Attorney, Agent, or Firm* — Oliff PLC

(57) ABSTRACT

There is provided a boom extending and retracting apparatus that can improve the convenience of the telescopic boom while reducing the burden on the operator. The boom extending and retracting apparatus of the crane chooses the mode of the fluid circuit between the normal fluid circuit and the differential fluid circuit to slide a plurality of boom members by one telescopic cylinder. After the operating lever is turned to an extension side and the controller starts extending the telescopic boom using the differential fluid circuit, when the operating lever is turned to the extension side again via the neutral position, the controller chooses the normal fluid circuit to extend the telescopic boom using the normal fluid circuit.

16 Claims, 10 Drawing Sheets

| DIFFERENTIAL CHANGEOVER SWITCH | POSITION OF TELESCOPIC OPERATING LEVER | | |
|---|---|---|---|
| | NEUTRAL POSITION P1 | EXTENSION SIDE | |
| | | REPEATED OPERATION TIME T1 < PREDETERMINED PERIOD OF TIME | REPEATED OPERATION TIME T1 ≧ PREDETERMINED PERIOD OF TIME |
| DIFFERENTIAL MODE | DIFFERENTIAL OUTPUT OFF | DIFFERENTIAL OUTPUT OFF | DIFFERENTIAL OUTPUT ON |
| NORMAL MODE | DIFFERENTIAL OUTPUT OFF | DIFFERENTIAL OUTPUT OFF | |

*FIG.10*

BOOM EXTENDING AND RETRACTING APPARATUS OF A CRANE

CROSS-REFERENCES TO RELATED APPLICATIONS

This application claims the benefit of Japanese Patent Application No. 2013-243984, filed Nov. 26, 2013, which is incorporated herein by reference.

BACKGROUND

1. Technical Field

The present invention relates to a boom extending and retracting apparatus that extends and retracts a telescopic boom of a crane.

2. Related Art

A crane is equipped with a telescopic boom to lift goods. There has been known a telescopic boom in which a plurality of boom members are provided as to be slid with respect to each other and one telescopic cylinder is provided to slide the plurality of boom members one by one to extend. However, when the plurality of boom members are slid one by one with one telescopic cylinder, it may take time to extend or retract the telescopic boom. Therefore, in a crane disclosed in Patent Literature 1, a differential fluid circuit as well as a normal fluid circuit is provided for a fluid circuit to inject fluid such as hydraulic oil into the telescopic cylinder. By extending the telescopic cylinder with the action of the differential fluid circuit, it is possible to increase the extension speed of the telescopic cylinder. Therefore, it is possible to shorten the extension time of the telescopic boom, and possible to improve the convenience.

Patent Literature 1: Japanese Patent No. 4040856

However, in Patent literature 1, an additional switch is used to change and select an activated one between the differential fluid circuit and the normal fluid circuit. In this case, in the course of the work, the operator of the crane always has to know and identify the selected and using circuit from the differential fluid circuit and the normal fluid circuit, while executing a complex crane operation of the telescopic boom. And, the operator has to flip the additional switch during the work repeatedly, in accordance with and based on the emphasizing usage state. Therefore, management items during the work are increased, and consequently the burden on the operator increases.

Thus, in a crane, both to reduce the burden on the operator and to improve the convenience of the telescopic boom are required to be realized.

The boom extending and retracting apparatus according to the present invention includes: a telescopic boom including a plurality of boom members that can slide with respect to each other; a telescopic cylinder configured to extend and retract the telescopic boom by sliding the plurality of boom members, the telescopic cylinder including: a cylinder tube having an internal space filled with fluid; and a piston rod having piston dividing the internal space of the cylinder tube into an extension-side oil chamber and a retraction-side oil chamber, the piston rod moving along an inner surface of the cylinder tube to extend and retract the telescopic cylinder; a fluid circuit including a normal fluid circuit and a differential fluid circuit, the normal fluid circuit injecting fluid only into the extension-side oil chamber of the telescopic cylinder, and the differential fluid circuit injecting the fluid into the extension-side oil chamber while the fluid in the retraction-side oil chamber can be moved to the extension-side oil chamber; a controller configured to choose one of the normal fluid circuit and the differential fluid circuit, in order to extend and retract the telescopic boom; and an operating lever turned from a neutral position in order to extend the telescopic boom, wherein after the operating lever is turned to an extension side and the controller starts extending the telescopic boom using the differential fluid circuit, when the operating lever is turned to the extension side again via the neutral position, the controller chooses the normal fluid circuit to extend the telescopic boom using the normal fluid circuit.

Preferably, the boom extending and retracting apparatus of the crane further including a detection member configured to detect an extension amount of the telescopic cylinder, wherein, in a case where the controller determined an interruption of the extension of the telescopic boom based on the detected extension amount by the detection member before the operating lever is turned back to the neutral position, the controller chooses the normal fluid circuit to extend the telescopic boom using the normal fluid circuit.

Preferably, the boom extending and retracting apparatus of the crane further including a timer configured to measure a repeated operation time that has counted from a turned back timing of the operating lever to the neutral position until the repeated operation of the operating lever to the extension side, wherein: when the repeated operation time is shorter than a predetermined period of time, the controller chooses the normal fluid circuit based on the repeated operation of the operating lever to the extension side, and changes the extension of the telescopic boom with using the normal fluid circuit; and when the repeated operation time is equal to or longer than the predetermined period of time, the controller chooses the differential fluid circuit based on the repeated operation of the operating lever to the extension side, and continues the extension of the telescopic boom with using the differential fluid circuit.

Preferably, the boom extending and retracting apparatus of the crane further including a switch configured to set an availability or unavailability of the differential fluid circuit, wherein, when the operating lever is repeatedly operated to the extension side, the controller chooses the normal fluid circuit regardless of the setting of the switch, and changes the extension of the telescopic boom with using the normal fluid circuit.

Preferably, the boom extending and retracting apparatus of the crane further including a display member configured to display the activated function of the fluid circuit between the normal fluid circuit and the differential fluid circuit.

With the present invention, when the operating lever was operated from the neutral position in the extension side as for the telescopic boom to be started to be extended with using the differential fluid circuit and then the operating lever is again operated in the extension side, the control part selects the normal fluid circuit mode. That is, the activating mode of the fluid circuit is switched from the differential fluid circuit to the normal fluid circuit. The operator can switch the activating mode of the fluid circuit just by turning the operating lever repeatedly in the extension side. Therefore, with the present invention, it is possible to achieve an improved convenience in which the normal fluid circuit and the differential fluid circuit can be used switchably to extend the telescopic boom. In addition, it is possible to realize the intuitively knowable handleability in which the operating lever is only and repeatedly operated in the extension side, and therefore to reduce the burden of the operator. Moreover, there is no need to provide any additional switch to flip the fluid circuit during the work, and therefore it is possible to reduce the cost for the switch and also to save the space for installing the switch.

BRIEF DESCRIPTION OF THE DRAWINGS

FIG. 10 is a drawing explaining the relationship between the setting of a mode switch and the action of a differential hydraulic circuit.

DESCRIPTION OF EXEMPLARY EMBODIMENTS

Hereinafter, embodiments of the present invention will be described with reference to the drawings.

Embodiment 1

Figure 1:
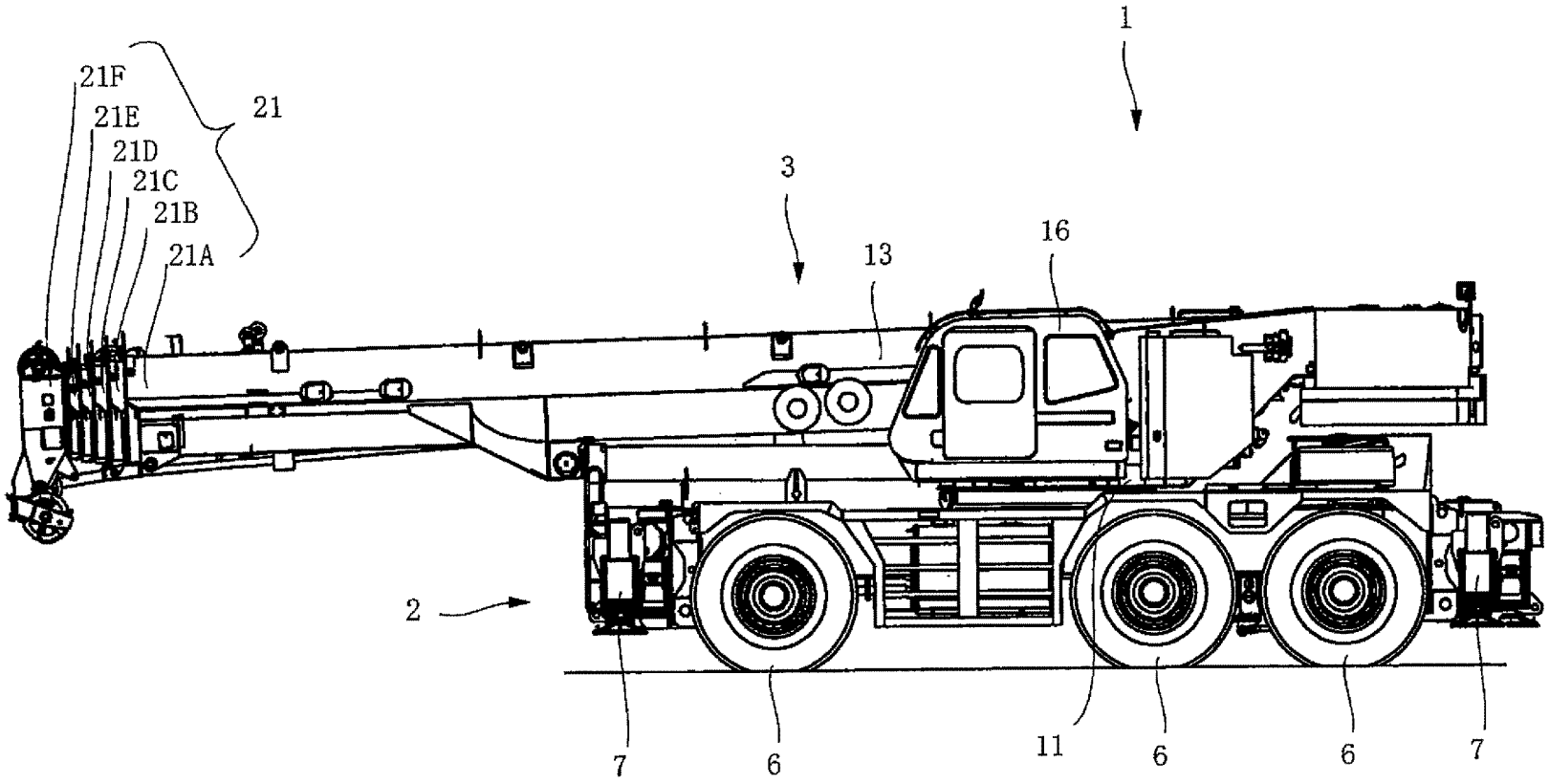
FIG. 1 is a side view of a mobile crane which is equipped with a boom extending and retracting apparatus according to Embodiment 1 of the present invention.

FIG. 1 is a side view of a mobile crane 1 which is equipped with a boom extending and retracting apparatus according to Embodiment 1 of the present invention. The mobile crane 1 in FIG. 1 includes a vehicle 2 and a crane apparatus 3. The vehicle 2 has wheels 6 and runs by an engine (not shown) as a power source. In addition, the vehicle 2 has outriggers 5 that can extend outwardly in the right-to-left direction from the sides of the vehicle 2. Each of the outriggers 7 has a hydraulic jack cylinder, and contacts with the ground when the jack cylinder is extended downwardly. When the outriggers 7 are extended outwardly in the right-to-left direction and contact with the ground there, the vehicle 2 is stabilized. As a result, it is possible to widen the operation range of the crane 1.

Figure 2:
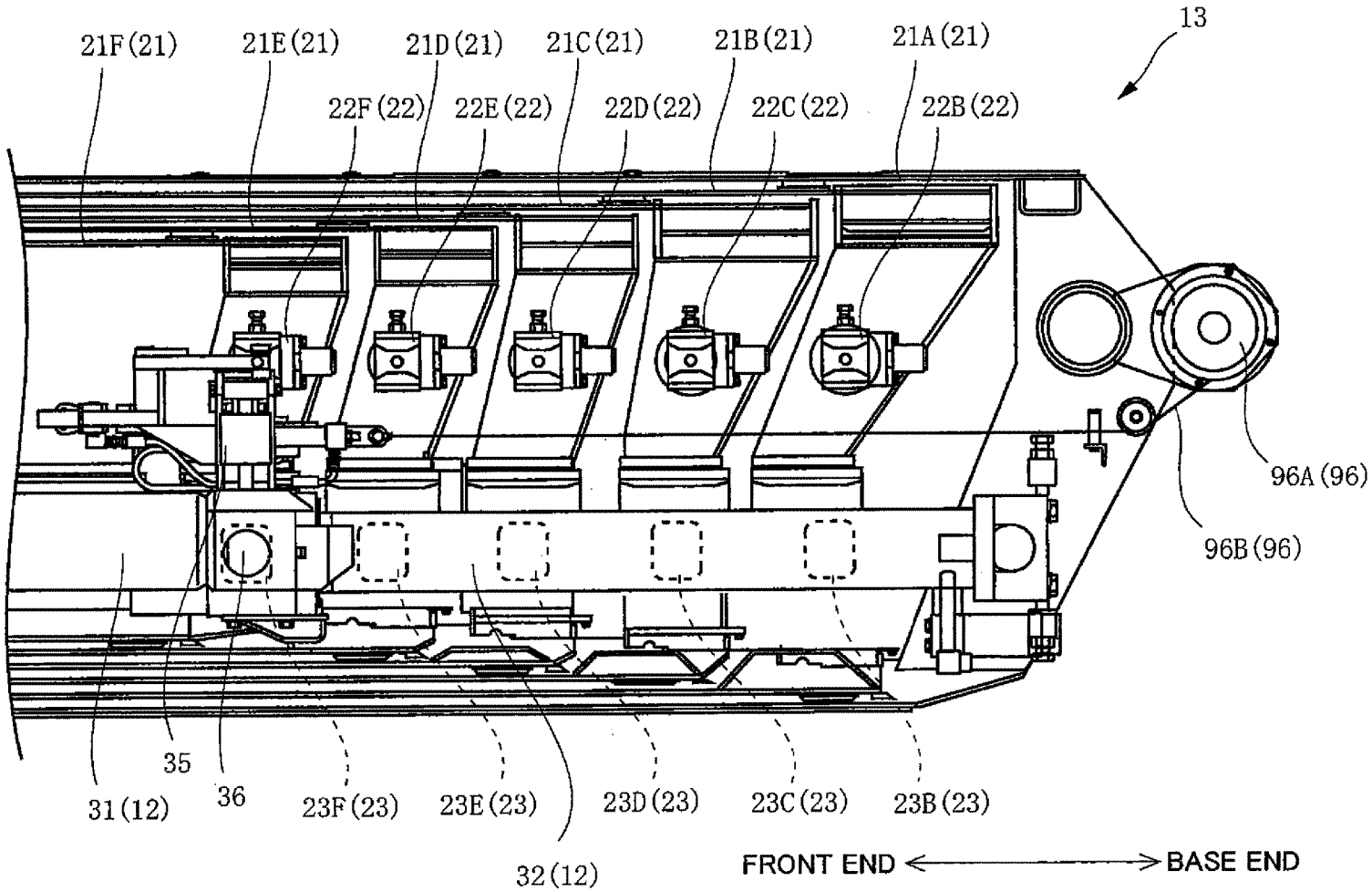
FIG. 2 is a partial cross-sectional view of the base end and peripheral parts of the telescopic boom of FIG. 1 that is maximally retracted.
Figure 3:
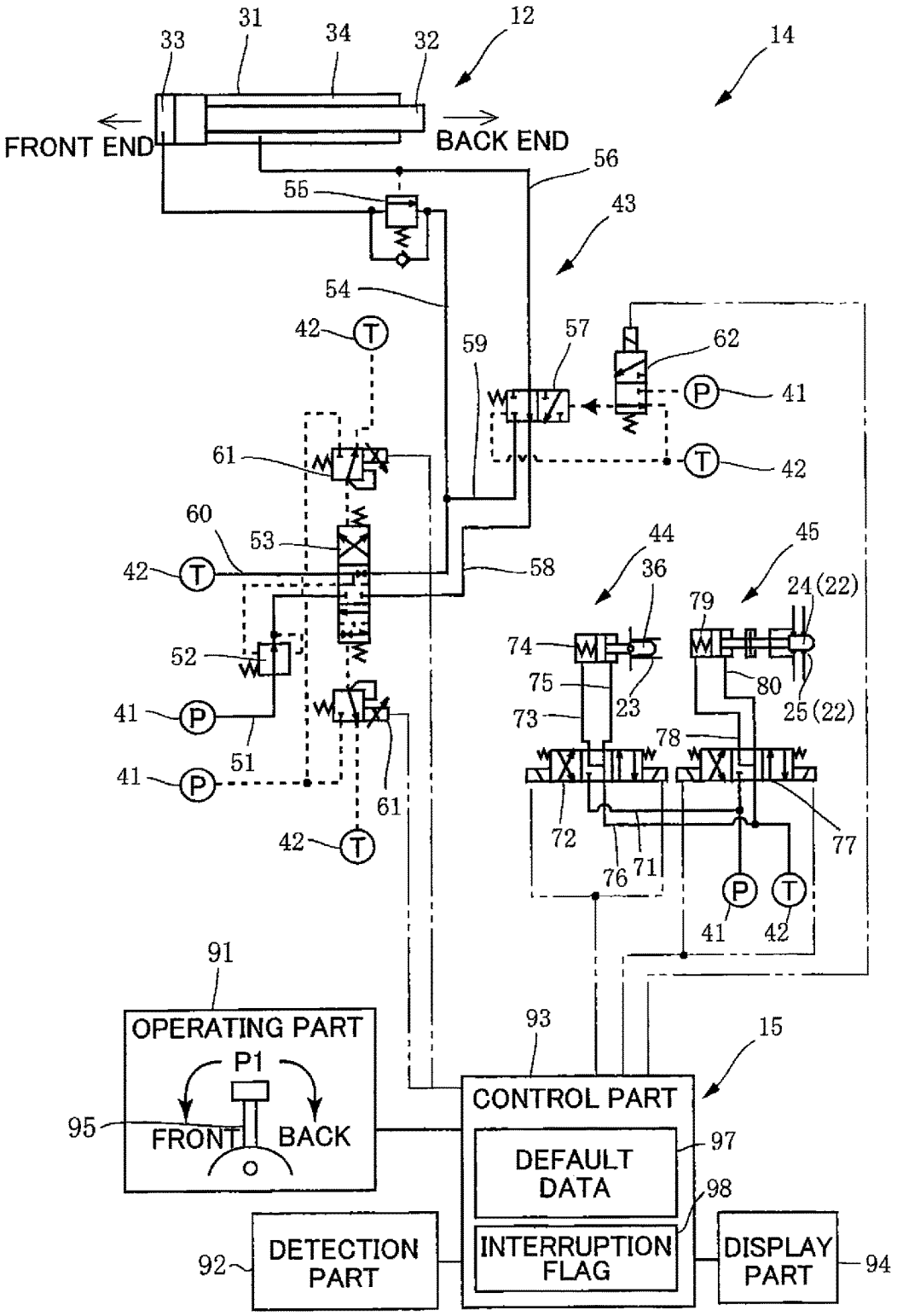
FIG. 3 is a drawing explaining a hydraulic circuit and a hydraulic control system for extending and retracting the telescopic boom in FIG. 1.

The crane apparatus 3 includes a swivel base 11, a telescopic boom 13 incorporating a telescopic cylinder 12 in FIG. 2, a hydraulic circuit 14 in FIG. 3, a hydraulic control system 15 in FIG. 3, and a cabin 16 in which the operator stays and operates the crane apparatus 3. The crane apparatus 3 functions as a boom expanding and retracting apparatus.

The swivel base 11 is provided on the frame of the vehicle 2. The swivel base 11 horizontally rotates upon the frame which is held in an approximately horizontal level.

The telescopic boom 13 employs a mechanism to extend and retract multiple boom members with one telescopic cylinder 12. The telescopic boom 13 includes a plurality of boom members 21. Each of the plurality of boom members 21 has a polygonal and cylindrical shape which is similar to each other therebetween, and is inserted into the outer accommodating boom members 21 as to form a nested configuration. In this nested state, each of the inside boom member 21 slides out from each of the outside boom member 21, and therefore the telescopic boom 13 extends. When the number of the nested boom members 21 is six, they are referred to as, in the order from the outside, a base boom member 21A, a second boom member 21B, a third boom member 21C, a fourth boom member 21D, a fifth boom member 21E, and a top boom member 21F. The base end of the base boom member 21A, which is the outmost boom member of the telescopic boom 13, is provided on the swivel base 11 and can be raised and lowered. By this means, the telescopic boom 13 can horizontally rotate together with the swivel base 11 on the frame of the vehicle 2, and can be raised and lowered by a boom cylinder with respect to the swivel base 11. In addition, the telescopic boom 13 can be extended and retracted. The operator gets in the cabin 16 of the mobile crane 1 and operates an operating part 91 in FIG. 3 to adjust the telescopic boom 13 in a desired direction and in a desired height. In this desired state, a wire is hanged down from the front end of the telescopic boom 13 and goods are suspended at a hook on the tip of the wire. The operator operates the operating part 91 to allow the mobile crane 1 to lift up and move the goods.

FIG. 2 is a partial cross-sectional view of the base end and the peripheral parts of the telescopic boom of FIG. 1 that is maximally retracted. FIG. 2 shows an exemplary telescopic boom 13 having six boom members 21. In this case, the base end of the base boom member 21A is provided on the swivel base 11 and can be raised and lowered. The second boom member 21B is disposed and inserted into the inside of the base boom member 21A. In the base end of the second boom member 21B, a second lock mechanism 22B and a second connecting hole 23B are provided. The second lock mechanism 22B connects the second boom member 21B to the base boom member 21A. The second connecting hole 23B is provided as a boom-side part of a lock mechanism for connecting the base end of the cylinder tube 31 to the second boom member 21B of the telescopic boom 13. The third boom member 21C is disposed and inserted into the inside of the second boom member 21B. In the base end of the third boom member 21C, a third lock mechanism 22C and a third connecting hole 23C are provided. The third lock mechanism 22C connects the third boom member 21C to the second boom member 21B. The third connecting hole 23C is provided as a boom-side part of a lock mechanism for connecting the base end of the cylinder tube 31 to the third boom member 21C of the telescopic boom 13. The fourth boom member 21D is disposed and inserted into the inside of the third boom member 21C. In the base end of the fourth boom member 21D, a forth lock mechanism 22D and a fourth connecting hole 23D are provided. The fourth lock mechanism 22D connects the fourth boom member 21D to the third boom member 21C. The fourth connecting hole 23D is provided as a boom-side part of a lock mechanism for connecting the base end of the cylinder tube 31 to the fourth boom member 21D of the telescopic boom 13. The fifth boom member 21E is disposed and inserted into the inside of the fourth boom member 21D. In the base end of the fifth boom member 21E, a fifth lock mechanism 22E and a fifth connecting hole 23E are provided. The fifth lock mechanism 22E connects the fifth boom member 21E to the fourth boom member 21D. The fifth connecting hole 23E is provided as a boom-side part of a lock mechanism for connecting the base end of the cylinder tube 31 to the fifth boom member 21E of the telescopic boom 13. The top boom member 21F is disposed and inserted into the inside of the fifth boom member 21E. In the base end of the top boom member 21F, a top lock mechanism 22F and a top connecting hole 23F are provided. The top lock mechanism 22F connects the top boom member 21F to the fifth boom member 21E. The top connecting hole 23F is provided as a boom-side part of a lock mechanism for connecting the base end of the cylinder tube 31 to the top boom member 21F of the telescopic boom 13. In FIG. 2, each of the top lock mechanism 22F, the fifth lock mechanism 22E, the fourth lock mechanism 22D, the third lock mechanism 22C, and the second lock mechanism 22B is positioned in the inside of the respective outside next boom member. These lock mechanisms are provided for the lock mechanism 22 to connect the boom members next to one another therebetween, and are arranged in the order from the front end of the telescopic boom 13 along the longitudinal direction of the telescopic boom 13 shown in FIG. 2. In addition, the top connecting hole 23F, the fifth connecting hole 23E, the fourth connecting hole 23D, the third connecting hole 23C and the second connecting hole 23B are formed in the respective boom members. These connecting holes are provided to connect the cylinder tube 31 and the respective boom members, and are arranged in the order from the front end of the telescopic boom 13 along the longitudinal direction of the telescopic boom 13 shown in FIG. 2.

The telescopic cylinder 12 is provided into the telescopic boom 13. The telescopic cylinder 12 is provided at the inside of the top boom member 21F. The telescopic cylinder 12 includes a long cylinder tube 31 and a piston rod 32. As described later in FIG. 3, the internal space of the cylinder tube 31 is filled with hydraulic oil. A piston rod 32 is inserted into the long cylinder tube 31 from an opening at one end of the cylinder tube 31. The internal space is divided into an extension-side oil chamber 33 and a retraction-side oil chamber 34 by a piston, which is located at one end of the piston rod 32 in the inserted side thereof. The extension-side oil chamber 33 and the retraction-side oil chamber 34 are connected to the hydraulic circuit 14. The telescopic cylinder 12 is a double-acting cylinder. The other end of the piston rod 32 that protrudes outside from the cylinder tube 31 is fixed to the base end of the base boom member 21A of the telescopic boom 13. In the telescopic boom 13, the piston rod 32 of the telescopic cylinder 12 is placed in the base end side of the telescopic boom 13. The cylinder tube 31 is placed in the top end side of the telescopic boom 13. The retraction-side oil chamber 34 is placed in the base end side of the telescopic boom 13. The extension-side oil chamber 33 is placed in the top end side of the telescopic boom 13. When the pressured oil is supplied to the extension-side oil chamber 33, the cylinder tube 31 can move to the front end direction of the telescopic boom 13 along with the longitudinal direction of the telescopic cylinder 12. Meanwhile, when the pressured oil is supplied to the retraction-side oil chamber 34, the cylinder tube 31 can move to the base end direction of the telescopic boom 13 along the longitudinal direction of the telescopic cylinder 12. As the piston rod 32 is fixed to the base end of the base boom member 21A of the telescopic boom 13, the cylinder tube 31 of the telescopic cylinder 12 can move along the longitudinal direction of the telescopic cylinder 12.

In the base end side of the cylinder tube 31, an interlock mechanism 35 and a connecting pin 36 are provided. As the telescopic cylinder 12 extends and retracts and the cylinder tube 31 moves in the longitudinal direction of the telescopic cylinder 12, the connecting pin 36 moves to the respective positions corresponding to the second connecting hole 23B, the third connecting hole 23C, the fourth connecting hole 23D, the fifth connecting hole 23E, and the top connecting hole 23F. The connecting pin 36 is connected to the corresponding connecting hole 23 of the boom member 21, by the action of the hydraulic circuit 14. In addition, in a state when the connecting pin 36 is positioned and connected to one of the connecting holes 23 of the boom members 21, the interlock mechanism 35 is placed at the corresponding position of the slender lock mechanism that is corresponding to the connecting holes 23 in the same boom member 21. In a case when the interlock mechanism 35 is placed in the corresponding position and the cylinder lock mechanism is locked, the boom side lock mechanism 22 can be detached from the outside next boom member 21. In other case, the boom side lock mechanism 22 is connected to the outside next boom member 21. In addition, the connecting pin 36 is removed from the connecting hole 23 by the action of the hydraulic circuit 14. Prior to that, the boom side lock mechanism 22 is connected to the outside next boom member 21 at the position in which the interlock mechanism 35 is detached. The boom member 21 is usually connected to the outside next boom member 21, and is disconnected from the outside next boom member 21 only when the connecting pin 36 is inserted into the connecting hole 23 as to be connected to the base end of the cylinder tube 31.

Then, for example in a state where the connecting pin 36 is connected to the top connecting hole 23F and the top lock mechanism 22F is released, when hydraulic pressure is applied to the extension-side oil chamber 33 by the action of the hydraulic circuit 14, the top boom member 21F slides from the position shown in FIG. 2 to the front end of the telescopic boom 13, together with the cylinder tube 31. As a result, the telescopic boom 13 is extended. Meanwhile, in a state where the connecting pin 36 is connected to the top connecting hole 23F and the top lock mechanism 22F is released, when hydraulic pressure is applied to the retraction-side oil chamber 34 by the action of the hydraulic circuit 14, the extended top boom member 21F slides to the base end of the telescopic boom 13, together with the cylinder tube 31. As a result, the telescopic boom 13 is retracted. In addition, in a state where the top boom member 21F is connected as for the top boom member 21F to be connected to the fifth boom member 21E, when the connecting pin 36 is removed from the top connecting hole 23F by the action of the hydraulic circuit 14, the cylinder tube 31 can move to the base end side and the connecting pin 36 is moved to the corresponding position to the fifth connecting hole 23E as to be connected to the fifth connecting hole 23E. Then, in a state where the lock mechanism 22E of the fifth boom member 21E is released, when hydraulic pressure is applied to the extension-side oil chamber 33 by the action of the hydraulic circuit 14, the fifth boom member 21E can move and slide to the front end of the telescopic boom 13. By repeating the above-described series of actions of the hydraulic circuit 14, the telescopic boom 13 is extended. Meanwhile, by repeating the above-described series of actions of the hydraulic circuit 14 in reverse, the telescopic boom 13 is retracted. In a maximally extended state of the telescopic boom 13, the top boom member 21F protrudes from the front end of the fifth boom member 21E, the fifth boom member 21E protrudes from the front end of the fourth boom member 21D, the fourth boom member 21D protrudes from the front end of the third boom member 21C, the third boom member 21C protrudes from the front end of the second boom member 21B, and the second boom member 21B protrudes from the front end of the base boom member 21A.

Here, in the boom side lock mechanism 22, when the interlock mechanism 35 is separated as to be able to move, by the action of the hydraulic circuit 14, a fixing pin 24 in FIG. 3 protrude outwardly and the provided fixing pin 24 is inserted into a fixing hole 25 shown in FIG. 3 formed in the outside next boom member 21. A plurality of fixing holes 25 are formed and arranged along the length direction of each of the boom member 21. Each of the inner boom members 21 is fixed at the given positions where the fixing holes 25 are formed and arranged from the top to the base of the outside next boom member 21. For example, the boom member 21 slid in the front side is fixed in the state in which the boom member 21 protrudes from the front end of the outside next boom member 21. Meanwhile, the boom member 21 slid in the base end side is fixed in the state in which the boom member 21 is nearly accommodated in the outside next boom member 21.

On the base end of the base boom member 21A of the telescopic boom 13, a detection member 96 is provided to detect an extension amount of the telescopic cylinder 12. The detection member 96 includes a detection reel 96A and a detection wire 96B. The detection reel 96A is rotatably provided on the base end of the base boom member 21A. The detection wire 96B is wound around the detection reel 96A. The front end of the detection wire 96B is fixed to the interlock mechanism 35 of the telescopic cylinder 12. When the interlock mechanism 35 moves to the front end side together with the cylinder tube 31, the detection wire 96B is drawn from the detection reel 96A. Meanwhile, when the interlock mechanism 35 moves to the base end side together with the cylinder tube 31, the detection wire 96B is wound around the detection reel 96A. The rotation amount of the detection reel 96A corresponds with the extension amount of the telescopic cylinder 12. The detection member 96 detects the rotation amount of the detection reel 96A, and outputs the detection result to a control part 93 of the hydraulic control system 15 described later. The control part 93 can calculate the extension length of the telescopic boom 13, based both on information of the boom side lock mechanism 22 which is connected with the interlock mechanism 35 and the detected value of the detection member 96.

FIG. 3 is a drawing explaining the hydraulic circuit 14 and the hydraulic control system 15 to extend the telescopic boom 13 in FIG. 1. The hydraulic circuit 14 has a hydraulic pump 41, a tank 42, a cylinder hydraulic circuit 43, a connecting hydraulic circuit 44 and a fixing hydraulic circuit 45. FIG. 3 also shows the telescopic cylinder 12, the extension-side oil chamber 33, the retraction-side oil chamber 34, the connecting portion of the telescopic cylinder 12 and the telescopic boom 13 by the connecting pin 36 and the connecting hole 23, and the fixing portion of the boom members 21 by the fixing pin 24 and the fixing hole 25. These members are hydraulic-controlled members that are driven by the hydraulic pressure of the hydraulic circuit 14. The hydraulic circuit 14 supplies the hydraulic oil outputted from the hydraulic pump 41 to the hydraulic-controlled members via a supply path. The hydraulic-controlled members are driven by the pressure of the hydraulic oil. At this time, part of the hydraulic oil is injected from the hydraulic-controlled members and then returns to the tank 42 via a circulation path. The hydraulic pump 41 sucks the hydraulic oil from the tank 42 and outputs the oil to the supply path. The hydraulic circuit 14 drives the hydraulic-controlled members by applying the pressure of the hydraulic oil to the hydraulic-controlled members.

The cylinder hydraulic circuit 43 extends and retracts the telescopic cylinder 12. The cylinder hydraulic circuit 43 includes a first supply path 51, a flow control valve 52, a pilot switching valve 53, a second supply path 54, a counter balance valve 55, a first circulation path 56, a hydro switching valve 57, a second circulation path 58, a bypass path 59, and a third circulation path 60. The first supply path 51 connects between the hydraulic pump 41 and the pilot switching valve 53. The flow control valve 52 is provided in the middle of the first supply path 51. The second supply path 54 connects the pilot switching valve 53 to the extension-side oil chamber 33 of the telescopic cylinder 12. The counter balance valve 55 is provided in the middle of the second supply path 54. The first circulation path 56 connects between the retraction-side oil chamber 34 of the telescopic cylinder 12 and the hydro switching valve 57. The second circulation path 58 connects between the hydro switching valve 57 and the pilot switching valve 53. The third circulation path 60 connects between the pilot switching valve 53 and the tank 42. The bypass path 59 connects between the hydro switching valve 57 and the second supply path 54. The flow control valve 52 adjusts the flow rate or the pressure of the hydraulic oil which is supplied from the hydraulic pump 41 to the pilot switching valve 53.

The pilot switching valve 53 switches the state of the telescopic cylinder 12, among extension, stop, and retraction. The pilot switching valve 53 has three switched states corresponding to three blocks shown in FIG. 3. In the extension state corresponding to the top block in FIG. 3, the pilot switching valve 53 connects the first supply path 51 to the second supply path 54, and also connects the second circulation path 58 to the third circulation path 60. In the stop state corresponding to the middle block in FIG. 3, the pilot switching valve 53 disconnects between the first supply path 51 and the second circulation path 58, and connects the second supply path 54 to the third circulation path 60. In the retraction state corresponding the bottom block in FIG. 3, the pilot switching valve 53 connects the first supply path 51 to the second circulation path 58, and also connects the second supply path 54 to the third circulation path 60. The state of the pilot switching valve 53 is controlled to be switched by the action of a pair of electromagnetic proportional valves 61. The counter balance valve 55 always allows hydraulic oil to be supplied in one direction, and allows hydraulic oil to be supplied in the reverse direction depending on conditions. Here, the counter balance valve 55 always allows the hydraulic oil to be supplied from the second supply path 54 to the extension-side oil chamber 33 of the telescopic cylinder 12, and allows hydraulic oil to be supplied in the reverse direction only when the hydraulic pressure is applied to the first circulation path 56.

The hydro switching valve 57 has two switched states in which the cylinder hydraulic circuit 43 is switched between a normal hydraulic circuit mode and a differential hydraulic circuit mode. In the switching state corresponding to the left block in FIG. 3, the hydro switching valve 57 connects the first circulation path 56 to the second circulation path 58. In this state, the cylinder hydraulic circuit 43 functions as a normal hydraulic circuit. In the switching state corresponding to the right clock in FIG. 3, the hydro switching valve 57 connects the first circulation path 56 to the bypass path 59. In this state, the cylinder hydraulic circuit 43 functions as a differential hydraulic circuit. The state of the hydro switching valve 57 is switched by the action of the first solenoid switching valve 62.

In order to function the cylinder hydraulic circuit 43 as the normal hydraulic circuit to extend the telescopic cylinder 12, the pilot switching valve 53 is switched to the extension state corresponding to the top block shown in FIG. 3 and the hydro switching valve 57 remains in the normal circuit state corresponding to the left block shown in FIG. 3. The pressured hydraulic oil by the hydraulic pump 41 is supplied through the first supply path 51 and the second supply path 54 to the extension-side oil chamber 33 of the telescopic cylinder 12. The piston rod 32 of the telescopic cylinder 12 is pushed by the pressure of the extension-side oil chamber 33. By this means, the telescopic cylinder 12 is extended. At this time, the hydraulic oil in the retraction-side oil chamber 34 of the telescopic cylinder 12 is injected from the telescopic cylinder 12, passes through the first circulation path 56, the second circulation path 58 and the third circulation path 60, and then is returned to the tank 42.

In order to function the cylinder hydraulic circuit 43 as the differential hydraulic circuit to extend the telescopic cylinder 12, the pilot switching valve 53 is switched to the extension state corresponding to the top block shown in FIG. 3, and the first solenoid switching valve 62 is switched as for the hydro switching valve 57 to be switched to the differential circuit state corresponding to the right block shown in FIG. 3. The circulation path 56 is connected to the first supply path 51 by the bypass path 59. The pressured hydraulic oil by the hydraulic pump 41 is supplied through the first supply path 51 and the second supply path 54 to the extension-side oil chamber 33 of the telescopic cylinder 12. The piston 32 of the telescopic cylinder 12 is pushed by the pressure of the extension-side oil chamber 33. By this means, the telescopic cylinder 12 is extended. At this time, the hydraulic oil in the retraction-side oil chamber 34 is injected from the telescopic cylinder 12, passes through the first circulation path 56, the bypass path 59 and the first supply path 51, and then is supplied to the extension-side oil chamber 33.

In the differential hydraulic circuit mode, the hydraulic oil in the retraction-side oil chamber 34 of the telescopic cylinder 12 is supplied to the extension-side oil chamber 33. Differently from the normal hydraulic circuit mode, there is no need to inject the hydraulic oil in the retraction-side oil chamber 34 to the tank 42. Almost all of the applied pressure to the extension-side oil chamber 33 by the hydraulic pump 41 is used to extend the telescopic cylinder 12. Thus, the piston rod 32 can move at a higher speed than in the normal hydraulic circuit mode within the internal space of the cylinder tube. Therefore, the telescopic boom 13 is extended at a high speed.

In order to function the cylinder hydraulic circuit 43 as the hydraulic circuit 14 to retract the telescopic cylinder 12, the pilot switching valve 53 is switched to the retraction state described as the bottom side block in FIG. 3, and the hydro switching valve 57 is kept in the normal circuit state described as the left side block in FIG. 3. The pressured hydraulic oil by the hydraulic pump 41 is supplied from the first supply path 51 through the second circulation path 58 and the first circulation path 56 to the retraction-side oil chamber 34 of the telescopic cylinder 12. The piston rod 32 of the telescopic cylinder 12 is pushed backward by the pressure of the retraction-side oil chamber 34. By this means, the telescopic cylinder 13 is retracted. At this time, the hydraulic oil in the extension-side oil chamber 33 is injected from the telescopic cylinder 12, passes through the second supply path 54 and the third circulation path 60, and is returned to the tank 42.

The connecting hydraulic circuit 44 drives the connecting pin 36, and controls the connection and disconnection between the connecting pin 36 and the connecting hole 23. The connecting hydraulic circuit 44 includes a third supply path 71, a second solenoid switching valve 72, a fourth supply path 73, a first drive cylinder 74 of the connecting pin 36, a fourth circulation path 75 and a fifth circulation path 76.

The third supply path 71 connects between the hydraulic pump 41 and the second solenoid switching valve 72. The fourth supply path 73 connects between the second solenoid switching valve 72 and the extension-side oil chamber of the first drive cylinder 74 for the connecting pin 36. The fourth circulation path 75 connects between the retraction-side oil chamber of the first drive cylinder 74 for the connecting pin 36 and the second solenoid switching valve 72. The fifth circulation path 76 connects between the second solenoid switching valve 72 and the tank 42. The second solenoid switching valve 72 switches the connecting state between the connecting pin 36 and the connecting hole 23, among connection, stop and disconnection. The second solenoid switching valve 72 has three switching states. In the connection state in the right side block of FIG. 3, the second solenoid switching valve 72 connects the third supply path 71 to the fourth supply path 73, and also connects the fourth circulation path 75 to the fifth circulation path 76. In the stop state in the middle block of FIG. 3, the second solenoid switching valve 72 disconnects the third supply path 71 from the hydraulic pump 41, and the connects the fourth supply path 73 and the fourth circulation path 75 to the fifth circulation path 76. In the disconnection state in the left side block of FIG. 3, the second solenoid switching valve 72 connects the third supply path 71 to the fourth circulation path 75, and also connects the fourth supply path 73 to the fifth circulation path 76.

For the connecting pin 36 provided in the cylinder tube 31 being engaged with and connected to the connecting hole 23 provided in the boom member 21, the second solenoid switching valve 72 is switched to the connection state described in the right side block of FIG. 3. The hydraulic pump 41 is connected to the extension-side oil chamber 33 of the first drive cylinder 74. The first drive cylinder 74 drives and moves the connecting pin 36 forward. The connecting pin 36 protrudes and engages with the connecting hole 23. By this means, the telescopic cylinder 12 is connected to the boom member 21. For the connecting pin 36 provided in the cylinder tube 31 being removed and disconnected from the connecting hole 23 provided in the boom member 21, the second solenoid switching valve 72 is switched to the disconnection state described in the left side block of FIG. 3. The hydraulic pump 41 is connected to the retraction-side oil chamber 34 of the first drive cylinder 74. The first drive cylinder 74 drives and moves the connecting pin 36 backward. By this means, the engagement between the connecting pin 36 and the connecting hole 23 is released, and therefore the telescopic cylinder 12 is separated from the boom member 21.

The fixing hydraulic circuit 45 fixes the boom members 21 to each other, and releases the fixed state. The fixing hydraulic circuit 45 includes the third supply path 71, a third solenoid switching valve 77, a fifth supply path 78, a second drive cylinder 79 of the fixing pin 24, a sixth circulation path 80 and a fifth circulation path 76.

The third supply path 71 connects between the hydraulic pump 41 and the third solenoid 77. The fifth supply path 78 connects between the third solenoid switching valve 77 and the extension-side oil chamber 33 of the second drive cylinder 79 for the fixing pin 24. The sixth circulation circuit 80 connects between the retraction-side oil chamber 34 of the second drive cylinder 79 for the fixing pin 24 and the third solenoid switching valve 77. The fifth circulation path 76 connects between the second solenoid switching valve 72 and the tank 42. The third solenoid switching valve 77 switches the state of the fixing pin 24, among connection, stop and disconnection. The third solenoid switching valve 77 has three switching state. In the connection state described in the right side block of FIG. 3, the third solenoid switching valve 77 connects the third supply path 71 to the fifth supply path 78, and also connects the sixth circulation path 80 to the fifth circulation path 76. In the stop state described in the middle block of FIG. 3, the third solenoid switching valve 77 disconnects the third supply path 71 from the hydraulic pump 41, and connects the fifth supply path 78 and the sixth circulation path 80 to the fifth circulation path 76. In the disconnection state described in the left side block of FIG. 3, the third solenoid switching valve 77 connects the third supply path 71 to the sixth circulation path 80, and also connects the fifth circulation path 78 to the fifth circulation path 76.

For the fixing pin 24 of the boom member 21 being engaged with the fixing hole 25 of the outside next boom member 21, the third solenoid switching valve 77 is switched to the connected state described in the right side block of FIG. 3. The hydraulic pump 41 is connected to the extension-side oil chamber 33 of the second drive cylinder 79. The second drive cylinder 79 drives and moves the fixing pin 24 forward. The fixing pin 24 is protruded and engaged with the fixing hole 25. The boom member 21 with the protruding fixing pin 24 is fixed to the outside next boom member 21. For the fixing pin 24 of the boom member 21 being removed from the fixing hole 25 of the outside next boom member 21, the third solenoid switching valve 77 is switched to the release state described in the left side block of FIG. 3. The hydraulic pump 41 is connected to the retraction-side oil chamber of the second drive cylinder 79. The second drive cylinder 79 drives and moves the fixing pin 24 backward. The engagement between the fixing pin 24 and the fixing hole 25 is released. By this means, the engagement between the boom member 21 and the outside next boom member 21 is released.

The hydraulic control system 15 in FIG. 3 includes an operating part 91, a detection part 92, the control part 93 and a display part 94.

Figure 4:
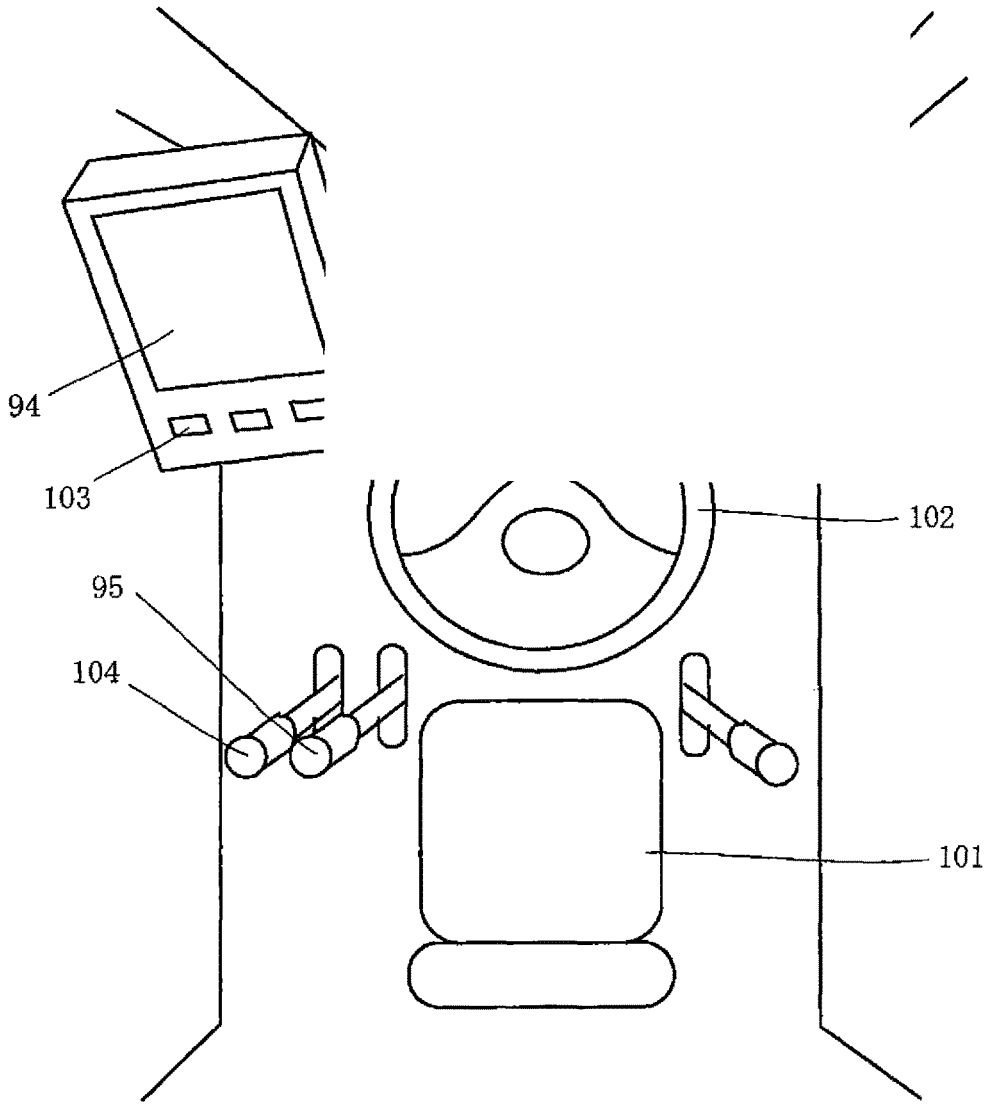
FIG. 4 is a top view of the inside of a cabin of the mobile crane in FIG. 1, where operating parts such as a telescopic operating lever and so forth are disposed.

The operating part 91 outputs a signal to operate the mobile crane 1 to the control part 93, based on the operation of the operator. FIG. 4 is a top view of the inside of the cabin 16 of the mobile crane 1 in FIG. 1, where operating parts 91 including a telescopic operating lever 95 and so forth are disposed. In the cabin 16 shown in FIG. 4, a plurality of operating levers, a handle 102 and a switch 103 are disposed around a seat 101 on which the operator sits. A pedal (not shown) is disposed below a front panel. The operating part 91 includes these operating members operated by the operator. In FIG. 4, the telescopic operating lever 95 for operating the telescopic boom 13 to be extended and retracted is disposed in the left side of the seat 101. A swivel operating lever 104 is disposed next to the telescopic operating lever 95. When the telescopic operating lever 95 is not operated, the telescopic operating lever 95 stands approximately in vertical direction as shown in FIG. 4 and is set in a neutral position P1. When the telescopic operating lever 95 is operated as to be tilted forward from the neutral position P1, the telescopic operating lever 95 outputs a command signal to extend the telescopic boom 13 to the control part 93.

The detection part 92 detects the operating state of the mobile crane 1, and outputs a detection signal to the control part 93. The detection part 92 has various detection sensors that detect the length and the boom angle of the telescopic boom 13, and the swivel angle of the swivel base 11. The detection part 92 in FIG. 2 for detecting the extension amount of the telescopic cylinder 12 is also included in the detection member 96, and thus outputs a detection signal to the control part 93.

The display part 94 displays the operating state and the action state of the mobile crane 1, based on a display signal from the control part 93. The display part 94 includes a liquid crystal monitor, a lamp and so forth. The liquid crystal monitor provided in the cabin 16 shown in FIG. 4 is a display part of an automatic moment limiter (AML), which displays the boom length and the boom angle of the telescopic boom 13. During the working of the crane 1, the display part 94 displays the activating state of the cylinder hydraulic circuit 43, which is switched between the normal hydraulic circuit mode and the differential hydraulic circuit mode.

The control part 93 is a controller, and may be a microcomputer including a CPU, a memory and so forth. The operating part 91, the detection part 92 and the display part 94 are connected to the control part 93. The control part 93 is connected to the hydraulic circuit 14. The control part 93 switches a plurality of switching valves in the hydraulic circuit 14. With the present embodiment, default data 97 and an interruption flag 98 are stored in the memory of the control part 93. In the default data 97, setting data is included for the differential hydraulic circuit to be used in the extension operation of the telescopic boom 13. The interruption flag 98 is placed when the extension of the telescopic boom 13 is interrupted during the extension control of the telescopic boom 13. The interruption flag 98 is used in the extension control of the telescopic boom 13. Here, the control part 93 may be provided in the AML of the cabin 16. Alternatively, the control part 93 may be provided in the other location within the vehicle 2.

Next, the extension control of the telescopic boom 13 in the mobile crane 1 of FIG. 1 will be described. Here, the extension control of the telescopic boom 13 with using the differential hydraulic circuit will be described. With the present embodiment, the control part 93 uses the differential hydraulic circuit to extend the telescopic boom 13, based on the default data 97. The operator operates the telescopic operating lever 95 to extend the telescopic boom 13. The telescopic operating lever 95 is titled forward, i.e. in the extension side, from the neutral position P1 to extend the telescopic boom 13. When the telescopic boom is extended in a desired length, the telescopic operating lever 95 is turned back to the neutral position P1.

Figure 5:
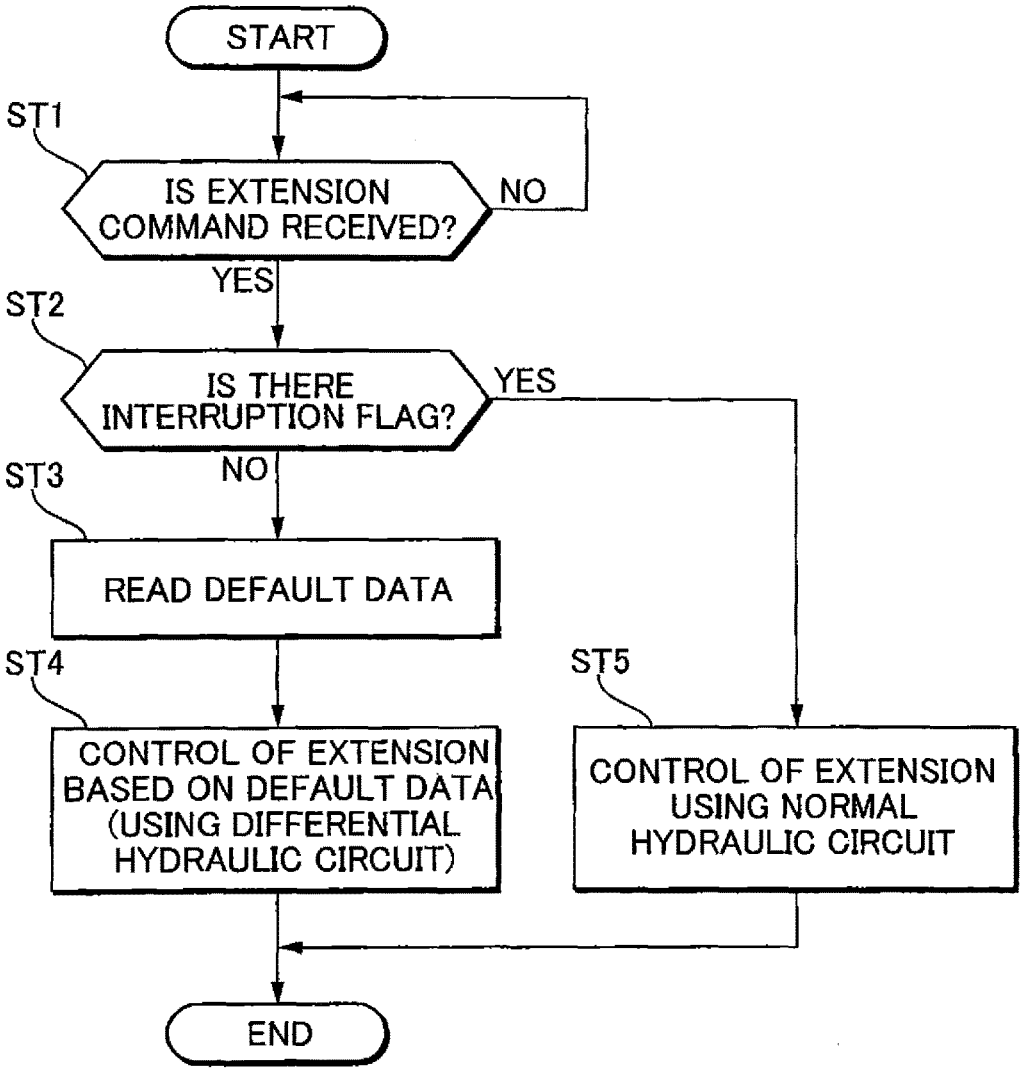
FIG. 5 is a controlling flowchart of a control part, which is executed when the telescopic operating lever is turned from the neutral position.
Figure 6:
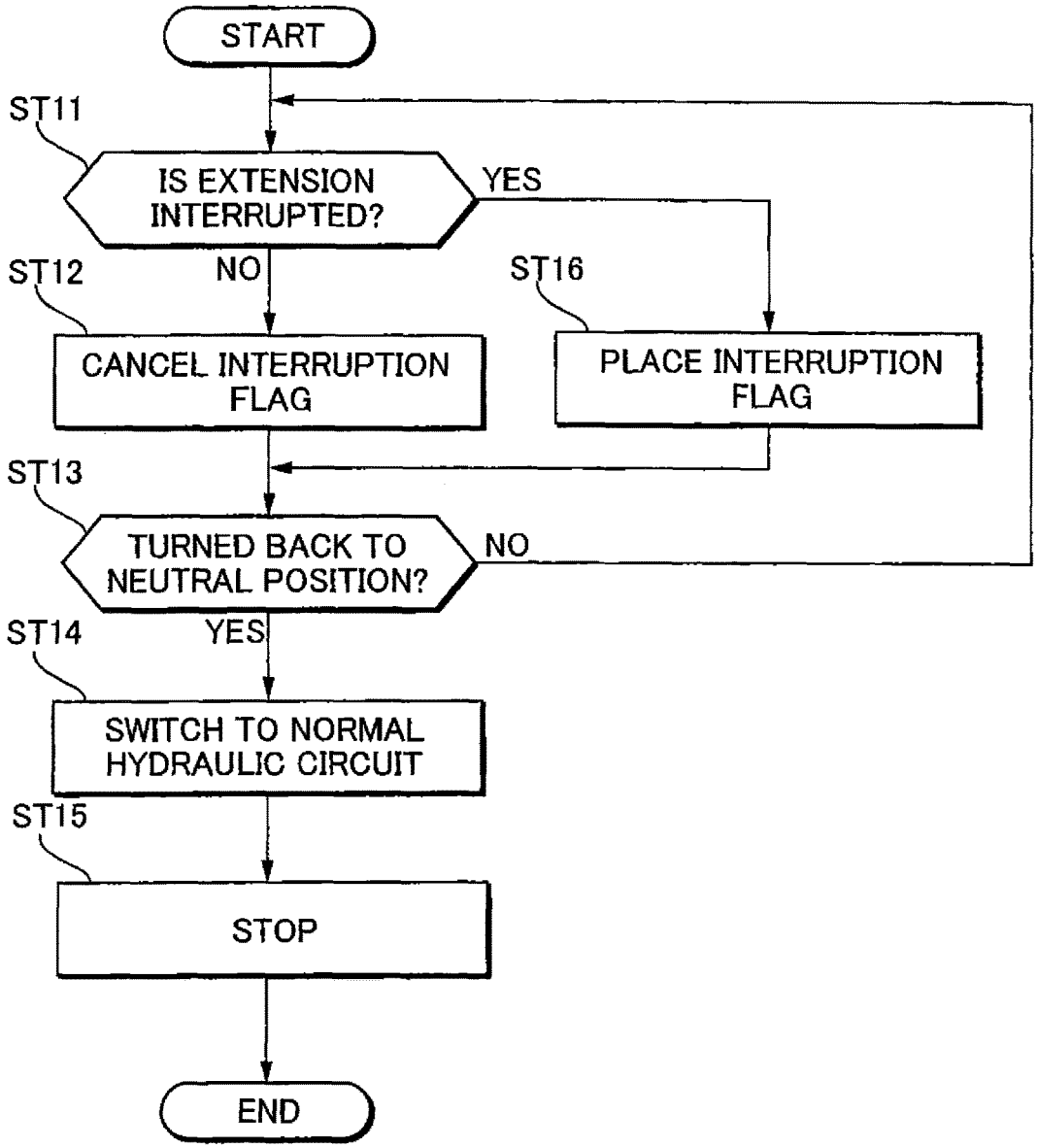
FIG. 6 is a controlling flowchart of the control part, which is performed when the telescopic operating lever is turned back to the neutral position.

FIG. 5 is a controlling flowchart of the control part 93, which is executed when the telescopic operating lever 95 is turned from the neutral position P1. FIG. 6 is a controlling flowchart of the control part 93, which is performed when the telescopic operating lever 95 is turned back to the neutral position P1.

For the telescopic boom 13 to be extended with using the differential hydraulic circuit, the operator operates the telescopic operating lever 95 by tilting it forward from the neutral position P1. The operating part 91 outputs a command signal for extending the telescopic boom 13 to the control part 93, based on the operation of the telescopic operating lever 95. Upon receiving the command signal for extending the telescopic boom 13 (step ST1), the control part 93 determines the presence or absence of the interruption flag 98 (step ST 2), and reads the default data 97 (step ST3). The control part 93 starts the extension control with using the differential hydraulic circuit, based on the default data 97 (step ST4).

In the extension control with using the differential hydraulic circuit, the control part 93 firstly controls and sets the connecting hydraulic circuit 44 as to connect the connecting pin 36 provided in the cylinder tube 31 to the top connecting hole 23F, and to disconnect the top boom member 21F from the outside next fifth boom member 21E. Next, the control part 93 switches the pilot switching valve 53 of the cylinder hydraulic circuit 43 from the stop state described as the middle block of FIG. 3 to the extension state described as the top block of FIG. 3, and keeps the hydro switching valve 57 in the normal circuit state described as the left side block of FIG. 3. Next, the control part 93 supplies the pressured oil by the hydraulic pump 41 to the cylinder hydraulic circuit 43. The cylinder hydraulic circuit 43 functions as the normal hydraulic circuit to extend the telescopic cylinder 12. Then, the top boom member 21F starts a sliding movement. After the top boom member 21F is started sliding by the action of the normal hydraulic circuit, the control part 93 switches the mode of the cylinder hydraulic circuit 43 from the normal hydraulic circuit mode to the differential hydraulic circuit mode. To be more specific, the control part 93 switches the state of the hydro switching valve 57 to the differential circuit state described in the right side block of FIG. 3 while keeping the pilot switching valve 53 of the cylinder hydraulic circuit 43 in the extension state described in the top side block of FIG. 3. The hydraulic oil in the retraction-side oil chamber 34 is flowed to the extension-side oil chamber 33 as to be circulated within the telescopic cylinder 12. Almost all of the pressure by the hydraulic pump 41 applied to the extension-side oil chamber 33 is used for the extension of the telescopic cylinder 12. By the action of the differential hydraulic circuit, the telescopic boom 13 can be extended at a high speed. When the top boom member 21 moves by sliding due to the action of the differential hydraulic circuit and is in a near from the front end of the fifth boom member 21E, the control part 93 switches the mode of the cylinder hydraulic circuit 43 from the differential hydraulic circuit mode back to the normal hydraulic circuit mode. To be more specific, the control part 93 switches the state of the hydro switching valve 57 to the normal circuit state described in the left side block of FIG. 3 while keeping the pilot switching valve 53 of the cylinder hydraulic circuit 43 in the extension state described in the top side block of FIG. 3. By this means, the hydraulic oil in the retraction-side oil chamber 34 of the telescopic cylinder 12 is discharged to the tank 42. Then, the extension speed of the telescopic boom 13 is reduced to a normal speed. Thereby, it is possible to reduce the shock caused when the top boom member 21F reaches at the front end of the fifth boom member 21E. When the top boom member 21F reaches at the front end of the fifth boom member 21E, the control part 93 stops the cylinder hydraulic circuit 43. To be more specific, the control part 93 switches the state of the pilot switching valve 53 of the cylinder hydraulic circuit 43 to the stop state described in the middle block of FIG. 3. The top boom member 21F stops at the front end of the fifth boom member 21E. Next, the control part 93 controls the connecting hydraulic circuit 44, to fix the top boom member 21F to the outside next fifth boom member 21E, and to disconnect the top boom member 21F from the telescopic cylinder 12. To be more specific, the control part 93 firstly inserts the fixing pin 24 of the top boom member 21F into the fixing hole 25 on the front end of the fifth boom member 21E, and then removes the connecting pin 36 provided in the cylinder tube 31 from the top connecting hole 23F. The top boom member 21F is separated from the telescopic cylinder 12, and is fixed to the front end of the fifth boom member 21E in a protruding state from the front end of the fifth boom member 21E.

After extending the top boom member 21F, the control part 93 continuously performs the extend control of the fifth boom member 21E. The control part 93 retracts the telescopic cylinder 12, which has been separated from the top connecting hole 23F. The control part 93 switches the state of the pilot switching valve 53 of the cylinder hydraulic circuit 43 to the retraction state described in the bottom side block of FIG. 3, and also switches the state of the hydro switching valve 57 to the normal circuit state descried in the left side block of FIG. 3. The control part 93 supplies the pressure of the hydraulic pump 41 to the cylinder hydraulic circuit 43. The control part 93 retracts the telescopic cylinder 12, until the connecting pin 36 provided in the cylinder tube 31 reaches at the corresponding position to the fifth connecting hole 23E. After the connecting pin 36 provided in the cylinder tube 31 was placed in the corresponding position to the fifth connecting hole 23E, the control part 93 engages the connecting pin 36 with the fifth connecting hole 23E, and then disconnects the fifth boom member 21E from the outside next fourth boom member 21D. After that, the control part 93 performs the extension control of the fifth boom member 21E. The detail of the extension control of the fifth boom member 21E may be in the same manner with that of the top boom member 21F as disclosed above. The fifth boom member 21E protrudes from the front end of the fourth boom member 21D, and is fixed there to the front end of the fourth boom member 21D.

The control part 93 sequentially performs the extension control of the forth boom member 21D, the third boom member 21C, and the second boom member 21B in the order, in the same way as that of the top boom member 21F.

When the telescopic boom 13 is extended in a desired length, the operator turns the telescopic operating lever 95 from the extension side back to the neutral position P1. The operating part 91 outputs a stop signal of the extension of the telescopic boom 13 to the control part 93, based on the operation of the telescopic operating lever 95. Upon receiving the stop signal of the extension of the telescopic boom 13, the control part 93 performs the flow shown in FIG. 6. The control part 93 firstly determines whether or not the extension is interrupted (step ST11). When the telescopic boom 13 has been extended to a desired length and the operator turns the telescopic operating lever 95 back to the neutral position P1, the control part 93 determines that the extension is not interrupted, and thus cancels the interruption flag 98 (step ST12). After that, the control part 93 confirms that the telescopic operating lever 95 has been turned back to the neutral position P1 (step ST13). The control part 93 repeats the above-described steps. After that, the control part 93 switches the mode of the cylinder hydraulic circuit 43 to the normal hydraulic circuit mode (step ST14), and stops supplying the hydraulic oil to the telescopic cylinder 12 (step ST15). As a result, the extension of the telescopic cylinder 12 is stopped.

As described above, the control part 93 performs the above steps for the extension control, during the period after the telescopic operating lever 95 is turned from the neutral position P1 until being turned back to the neutral position P1. By this extension control, the telescopic boom 13 is extended to the length at the time the telescopic operating lever 95 is turned back to the neutral position P1.

Meanwhile, when the cylinder hydraulic circuit 43 functions as the differential hydraulic circuit to extend the telescopic cylinder 12, it is possible to increase the extension speed of the telescopic cylinder 12 as described above. However, in this case, the power to extend the telescopic cylinder 12 is not enough depending on the extension condition of the extension of the telescopic boom 13, for example, and therefore the telescopic cylinder 12 is likely to stop during the differential hydraulic circuit mode. If so, the extension of the telescopic boom 13 is interrupted, and therefore it is not possible to extend the telescopic boom any longer.

When this interruption is occurred during the extension control of the telescopic boom 13 using the differential hydraulic circuit, the operator turns the extension side telescopic operating lever 95 in the back to the neutral position P1, and turns again the telescopic operating lever 95 to the extension side. Hereinafter, the control based on the repeating operation will be described.

When the interruption of the extension of the telescopic boom 13 occurs during the control of the extension of the telescopic boom 13 using the differential hydraulic circuit, and then the telescopic operating lever 95 is turned from the extension side back to the neutral position 21, the control part 93 performs the control flow of FIG. 6, and determines whether or not the extension of the telescopic cylinder 12 is interrupted (step ST11). The control part 93 determines that the extension of the telescopic boom 13 is interrupted, for example, based on the fact that the detected value from the detection member 96 that detects the extension amount of the telescopic cylinder 12 is not changing at the timing. Then, the control part 93 places the interruption flag 98 (step ST16). Then, the control part 93 confirms that the telescopic operating lever 95 is turned from the extension side back to the neutral position P1 (step ST13). After that, the control part 93 switches the mode of the cylinder hydraulic circuit 43 to the normal hydraulic circuit mode (step ST14), and stops supplying the hydraulic oil to the telescopic cylinder 12 (step ST15). As a result, the extension control of the telescopic cylinder 12 is interrupted.

After the interruption of the extension occurred during the extension control of the telescopic boom 13 using the differential hydraulic circuit, when the telescopic operating lever 95 is operated again, the control part 93 determines whether or not a command signal is received for extension, which was generated based on the operation of the telescopic operating lever 95, according to the control flow of FIG. 5 (step ST1). Next, the control part 93 determines the presence or absence of the interruption flag 98 (step ST2). Here, there is a state in which the interruption of the extension of the telescopic cylinder 12 was occurred and the telescopic operating lever 95 is turned again to the extension side, and therefore the interruption flag 98 is placed by the process of the step ST16. The control part 93 determines the presence of the interruption flag 98. The control part 93 allows the cylinder hydraulic circuit 43 to function as the normal hydraulic circuit (step ST5). As a result, the control part 93 starts the extension control with using the normal hydraulic circuit. Here, the control part 93 does not perform the control based on the default data 97. With the action of the normal hydraulic circuit, the telescopic cylinder 12 is extended.

As described above, in a state after the interruption of the extension occurred during the control of the extension of the telescopic boom 13 using the differential hydraulic circuit and where the telescopic operating lever 95 is turned again to the extension side, the control part 93 allows the cylinder hydraulic circuit 43 to function as the normal hydraulic circuit, regardless of the default setting. Therefore, even in a case where the cylinder hydraulic circuit 43 functions as the differential hydraulic circuit and where the extension power of the telescopic cylinder 12 is not enough, and therefore the extension of the telescopic cylinder 12 is interrupted, it is possible to extend the telescopic cylinder 12 with the cylinder hydraulic circuit 43 in the normal hydraulic circuit mode. In this way, the extension of the telescopic cylinder 12 is restarted, and therefore it is possible to extend the telescopic boom 13 to a desired length.

As described above, with the present embodiment, in the case in which the telescopic operating lever 95 is turned back to the neutral position P1 during the extension of the telescopic boom 13 using the differential hydraulic circuit and then is turned again to the extension side, the control part determines that interruption of the extension of the telescopic boom 13, based on the detected extension amount by the detection member 96 before the telescopic operating lever 95 is tuned to the neutral position 91, and selects the normal hydraulic circuit mode. By this means, the extension control of the telescopic boom 13 is switched from the control using the differential hydraulic circuit to the control using the normal hydraulic circuit. Therefore, for example, in a case where the extension of the telescopic boom 13 was interrupted during the extension control with using the differential hydraulic circuit and then the telescopic operating lever 95 is turned again to the extension side via the neutral position P1, the control part 93 automatically switches the mode of the cylinder hydraulic circuit 43 for extending the telescopic boom 13 from the differential hydraulic circuit mode to the normal hydraulic circuit mode, and therefore to restart the extension of the telescopic boom 13. By this means, even in a case where the action as the differential hydraulic circuit cannot provide enough power to extend the telescopic boom 13, it is possible to extend the telescopic boom 13 by the strong power with the normal hydraulic circuit. Therefore, it is possible to realize both of the high speed extension of the telescopic boom 13 and the reliable extension in which the telescopic boom 13 can extend in any extending state.

Moreover, the operator can switch the mode of the hydraulic circuit 14 only by turning again the telescopic operating lever 95 to the extension side. The operator is not required to recognize and to distinguish in the every aspect of the operation, between the acting state as the differential hydraulic circuit and the acting state as the normal hydraulic circuit. For example, when the operator has confirmed the interruption of the extension and turns the telescopic operating lever 95 again intuitively to the extension side, the mode of the hydraulic circuit 14 is automatically switched, and the extension of the telescopic boom 13 is restarted therewith. When the cylinder hydraulic circuit 43 can function as the differential hydraulic circuit and the normal hydraulic circuit, operator intrinsically always required to know which of the modes is used as the cylinder hydraulic circuit 43. However, it is not required to concern it with the present embodiment. Therefore, the controlling items during the operation of the crane 1 are not increased. Then, the operator does not required to emphasis the mode of the cylinder hydraulic circuit 14 in use, and can select unconsciously the proper mode of the cylinder hydraulic circuit 14 to extend the telescopic boom 13 with the intuitive and simply operation of the telescopic operating lever. Moreover, an additional switch is not required for changing the mode of the hydraulic circuit 14 during the work. By this means, the burden on the operator of the crane apparatus 3 is not increased. The operator can concentrate on the essential operations of the crane.

As a result, with the present embodiment, it is possible to improve the convenience of the telescopic boom 13 while reducing the burden on the operator. In addition, an additional switch does not need to change the mode of the cylinder hydraulic circuit 43 in the hydraulic circuit 14, and therefore it is possible to eliminate the cost for the switch and save the space in which the switch is installed.

With the present embodiment, the detection member 96 is provided for detecting the extension amount of the telescopic cylinder 12, and the control part 93 determines the interruption of the extension of the telescopic boom 13 during the extension of the telescopic boom 13 using the differential hydraulic circuit. Therefore, the control part 93 can determines the situation where the extension power is not enough to extend the telescopic boom 13 during the extension of the telescopic boom 13 using the differential hydraulic circuit, based on the detection result of the detection member 96 for detecting the extension amount of the telescopic cylinder 12. Here, the control part 93 may determine the interruption of the extension of the telescopic boom 13, based on a detection signal from a component other than the detection member 96. For example, the control part 93 may determine the interruption of the extension of the telescopic boom 13, based on a detection signal from a detection member for detecting the stop of the extension of the telescopic boom 13.

Embodiment 2

Next, the boom extending and retracting apparatus according to Embodiment 2 will be described. The basic configurations and the actions of the mobile crane 1 and the boom extending and retracting apparatus are the same as in Embodiment 1, and therefore the same reference numerals are assigned and overlapping description will be omitted. Hereinafter, the difference from Embodiment 1 will be mainly described.

Figure 7:
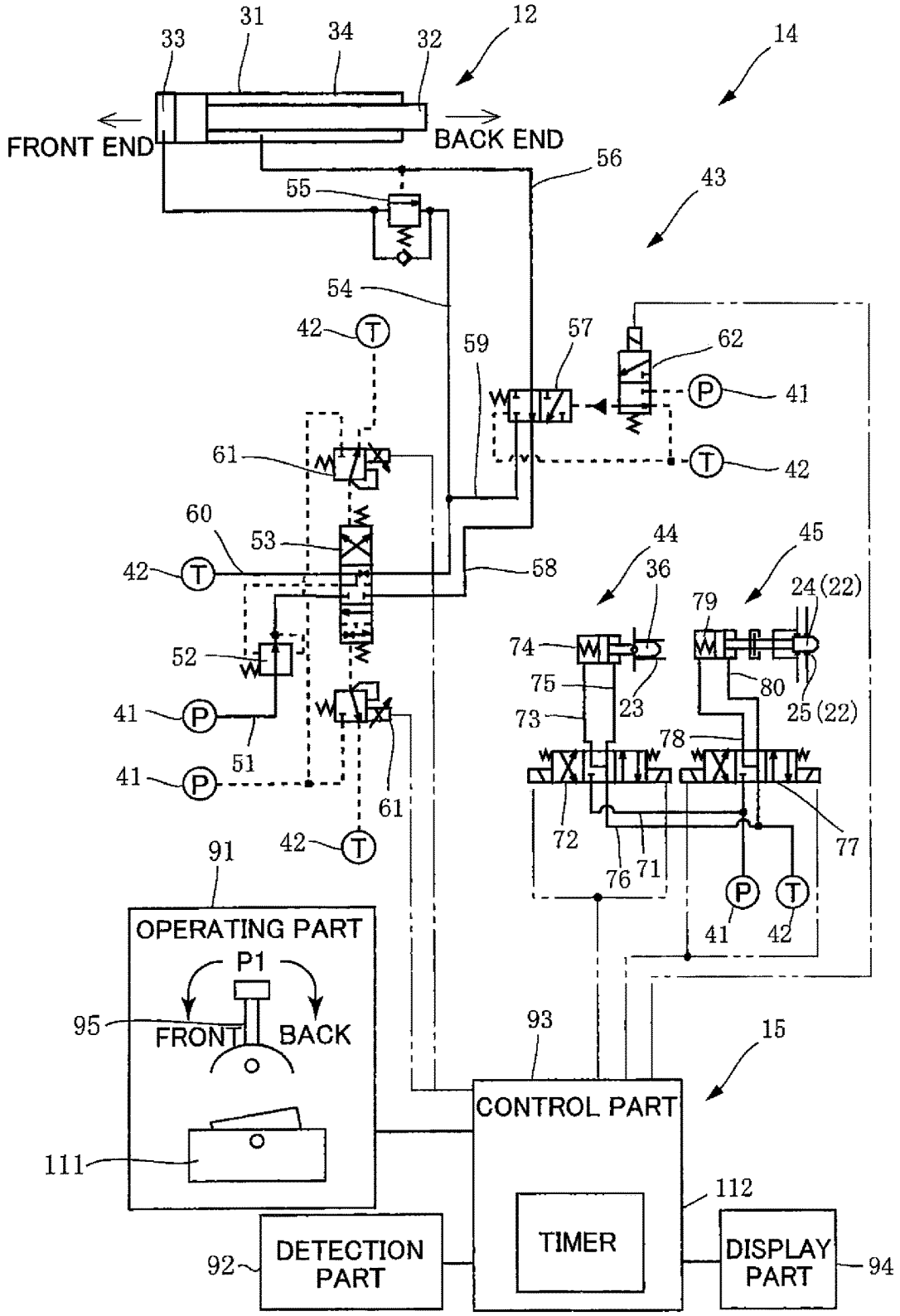
FIG. 7 is a drawing explaining a hydraulic circuit and a hydraulic control system according to Embodiment 2 of the present invention.

FIG. 7 is a drawing explaining the hydraulic circuit 14 and the hydraulic control system 15 of the boom extending and retracting apparatus according to Embodiment 2 of the present invention. The hydraulic circuit 14 is the same as in Embodiment 1.

The operating part 91 of the hydraulic control system 15 has a differential changeover switch 111 to select and to set the usage of the differential hydraulic circuit mode. The differential changeover switch 111 can selects between the using mode of the differential hydraulic circuit and the un-using mode of the differential hydraulic circuit. The differential changeover switch 111 outputs a mode signal according to the selected mode to the control part 93. Here, the differential changeover switch 111 may be disposed in the cabin 16. The differential changeover switch 111 may be provided as one of the switches 103 (see FIG. 4) of the AML.

The control part 93 includes a timer 112. The timer 112 may be incorporated into the microcomputer as a control part. The timer 112 measures the elapsed time after the telescopic operating lever 95 being turned back to the neutral position P1.

Figure 8:
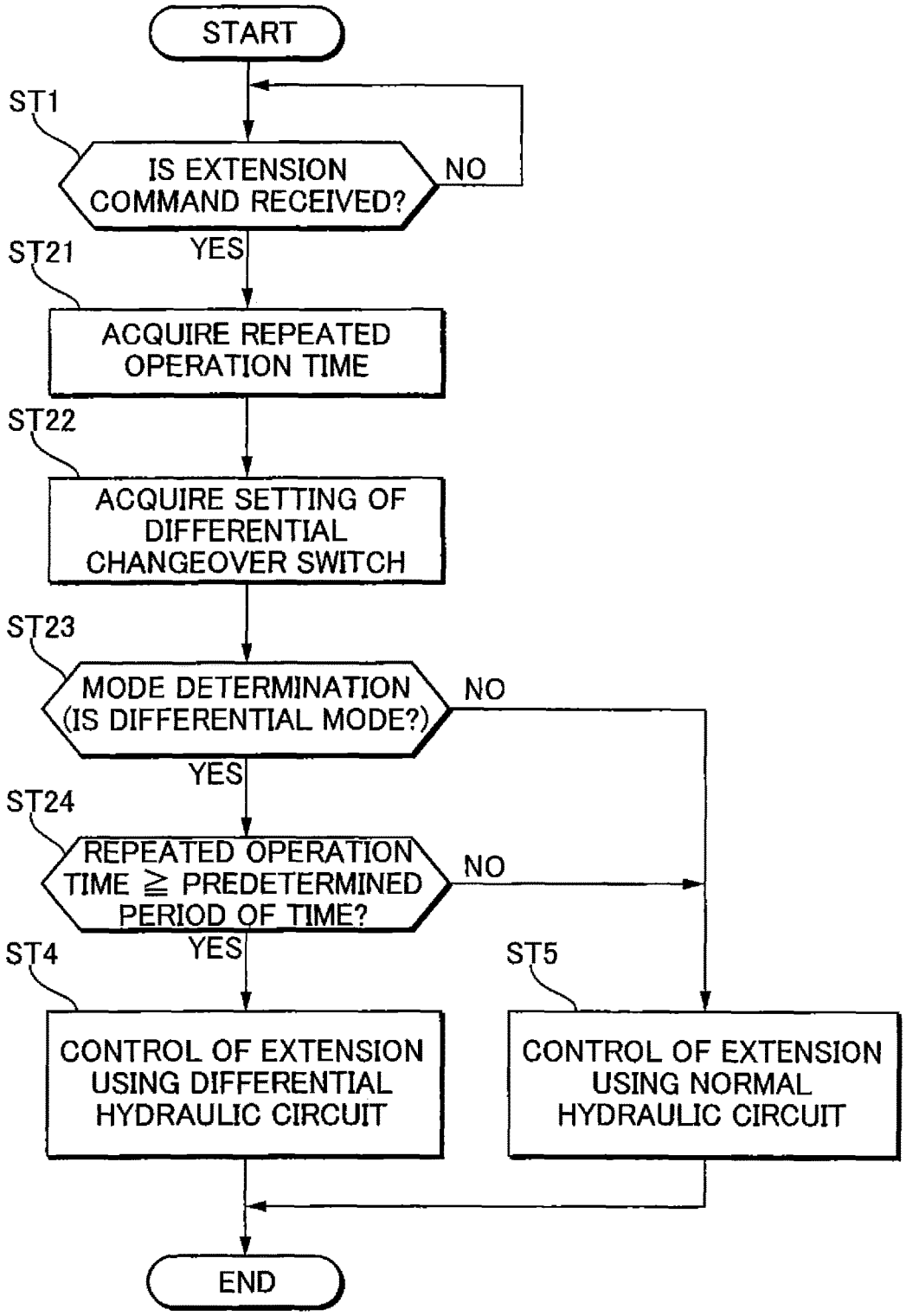
FIG. 8 is a controlling flowchart of the controller, which is executed when the telescopic operating lever is turned from the neutral position.
Figure 9:
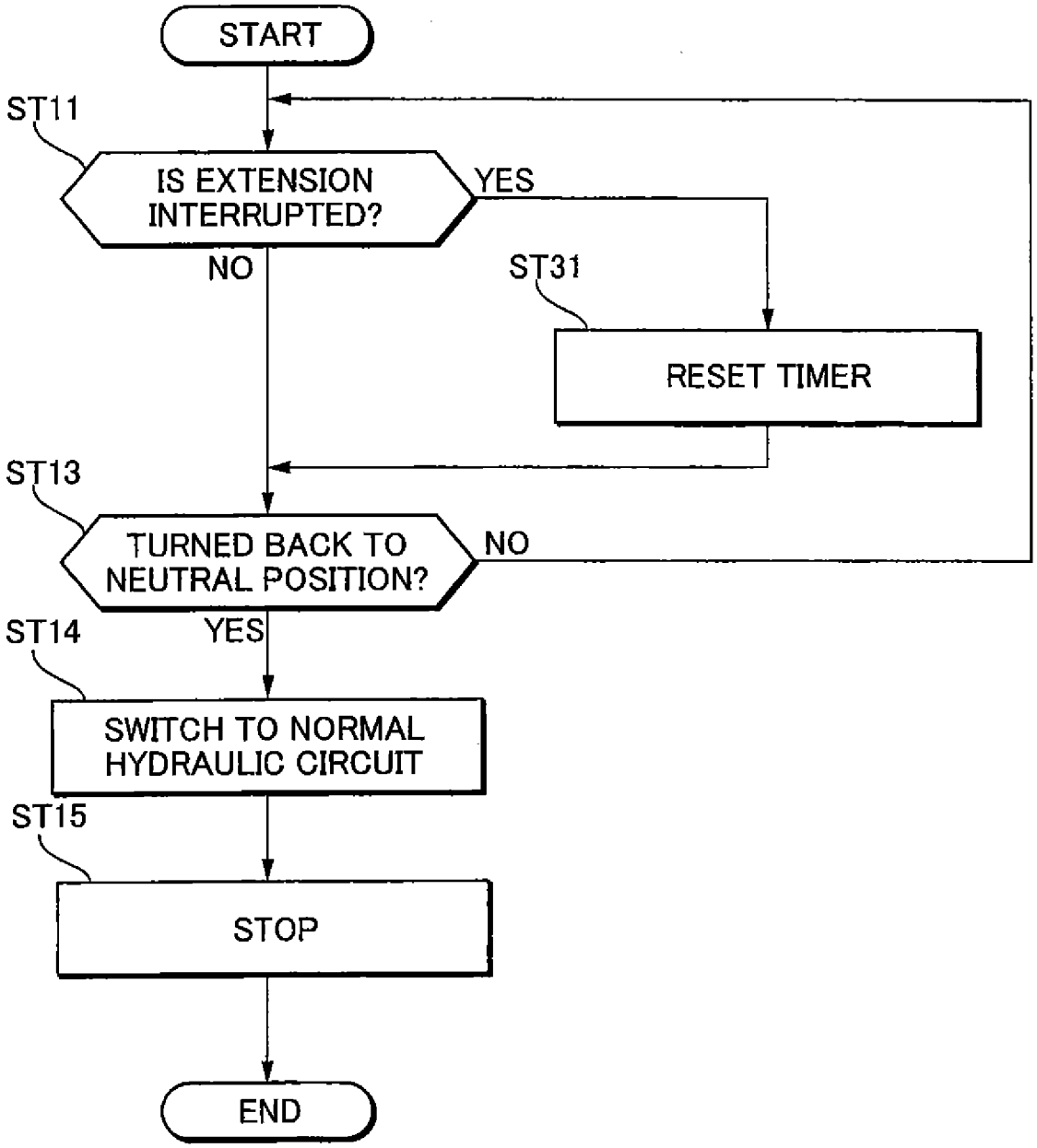
FIG. 9 is a controlling flowchart of the control part, which is performed when the telescopic operating lever is turned back to the neutral position.

FIG. 8 is a controlling flowchart of the control part 93, which is executed when the telescopic operating lever 95 is turned from the neutral position P1. FIG. 9 is a controlling flowchart of the control part 93, which is performed when the telescopic operating lever 95 is turned back to the neutral position P1.

Here, the controlling flowcharts in FIG. 8 and FIG. 9 will be explained with an example situation in which the extension of the telescopic boom 13 is interrupted during the extension control of the telescopic boom 13 using the differential hydraulic circuit. In this situation, the operator turns back the telescopic operating lever 95 from the extension side to the neutral position 21, and further turns again the telescopic operating lever 95 to the extension side. After being turned back to the neutral position P1, the telescopic operating lever 95 is tilted forward again from the neutral position P1.

When the extension of the telescopic boom 13 was interrupted during the extension control of the telescopic boom 13 using the differential hydraulic circuit and then the telescopic operating lever 95 is turned from the extension side back to the neutral position P1, the control part 93 determines that the extension of the telescopic cylinder 13 is interrupted, based on the control flow of FIG. 9 (step ST11). Then, the control part 93 resets the timer 112 (step ST31). The timer 112 starts measuring the elapsed time that has passed after the telescopic operating lever 95 is turned back to the neutral position P1 from the extension side. Here, in a case in which the extension of the telescopic cylinder 12 is not interrupted, the timer 112 is not reset. After that, the control part 93 confirms that the telescopic operating lever 15 is turned back to the neutral position P1 (STEP st13), switches the mode of the cylinder hydraulic circuit 43 to the normal hydraulic circuit mode (step ST14), and stops supplying the hydraulic oil to the telescopic cylinder 12 (step ST15). As a result, the driving of the telescopic cylinder 12 is stopped.

After that, when the telescopic operating lever 95 set in the neutral position P1 is tuned to the extension side again, the control part 93 determines that an extension command signal is received based on the operation of the telescopic operating lever 95 (step ST1), according to the control flow of FIG. 8. Then, upon receiving the extension command signal, the control part 93 acquires the measured elapsed time after the reset (hereinafter "repeated operation time T1") by the timer 112 (step ST21).

Next, the control part 93 acquires the setting of the differential changeover switch (step ST22). Then, the control part 93 performs and determines the operation mode whether the differential hydraulic circuit mode is adopted or not, based on the acquired setting of the differential changeover switch 111 (step ST23). Here, the differential change over switch 111 is set in the differential side to adopt the differential hydraulic circuit mode, for example. In this mode, the differential hydraulic circuit is activated and used. In this case, the control part 93 determines whether or not the acquired repeated operation time T1 is shorter than a predetermined period of time (step ST24). The predetermined period of time is 10 seconds, for example. The predetermined period of time may be some seconds other than 10 seconds, or be in a time by minutes.

When the repeated operation time T1 is shorter than the predetermined period of time, the control part 93 operates the cylinder hydraulic circuit 43 in the normal hydraulic circuit mode (step ST5). Here, the telescopic operating lever 95 is immediately turned again to the extension side, the cylinder hydraulic circuit 43 is operated in the normal hydraulic circuit mode. By the action of the normal hydraulic circuit, the telescopic cylinder 12 is extended. Therefore, in the case in which the telescopic operating lever 95 is tuned to the extension side again in shortly after the interruption of the extension of the telescopic boom 13, the control part 93 operates the cylinder hydraulic circuit 43 in the normal hydraulic circuit mode. The control part 93 operates the cylinder hydraulic circuit 43 in the normal hydraulic circuit, regardless of the setting of the differential changeover switch 111. Therefore, even in the case where the cylinder hydraulic circuit 43 is operated in the differential hydraulic circuit mode, the extension power for the telescopic cylinder 12 is not enough, and therefore the extension of the telescopic cylinder 13 is interrupted, it is possible to extend the telescopic cylinder 12 by using the normal hydraulic circuit. It is possible to restart the extension of the telescopic boom 13 that has been interrupted, and therefore to extend the telescopic boom 13 from the interrupted length to a desired length.

Next, the other differences between Embodiment 1 and Embodiment 2 will be further described, regarding the normal extension control of the telescopic boom 13 according to Embodiment 2. In order to extend the telescopic boom 13, the operator operates the telescopic operating lever 95 to be tilted forward, that is, tilted from the neutral position 91 to the extension side. According to the control flow of FIG. 8, the control part 93 determines whether or not an extension command signal has been received based on the operation of the telescopic operating lever 95 (step ST1). Next, the control part 93 acquires the repeated operation time T1 which has been measured by the timer 113 after the reset (step ST21), acquires the setting of the differential changeover switch 111 (step ST 22), and performs the mode determination (step ST23). After that, the control part 93 compares the acquired repeated operation time T1 with a predetermined period of time (step ST24). In a case where the telescopic boom 13 is going to be extended, the repeated operation time T1 is usually equal to or longer than the predetermined period of time, because usually a long period of time has already passed from the time of the previous operation. The control part 93 determines that the repeated operation time T1 is not shorter than the predetermined period of time. Then, the control part 93 starts the extension control, based on the selected setting of the differential changeover switch 111.

When the setting of the differential changeover switch 111 is in the differential hydraulic circuit mode, the control part 93 performs the extension control with using the differential hydraulic circuit in the same way as in Embodiment 1 (step ST4). The control part 93 extends the telescopic boom 13, as switching the mode of the cylinder hydraulic circuit 43 between the normal hydraulic circuit and the differential hydraulic circuit. As a result, the telescopic boom 13 is extended at a high speed. Meanwhile, the setting of the differential changeover switch 111 is not in the differential hydraulic circuit mode, the control part 93 performs the extension control with using only the normal hydraulic circuit mode (step ST5). The control part 93 extends the telescopic boom 13 with the activated normal hydraulic circuit mode. The telescopic boom 13 extends at a normal speed.

FIG. 10 is a drawing explaining the relationship between the setting of the differential changeover switch 111 and the action of the differential hydraulic circuit. In FIG. 10, "differential mode" in the first row means the setting state of the differential changeover switch 111 when the differential hydraulic circuit mode is adopted. "Normal mode" in the second row means the setting state of the differential changeover switch 111 when the differential hydraulic circuit mode is not adopted.

In a case where the differential changeover switch 111 is set in "differential mode" which means that the differential hydraulic circuit mode is adopted, the cylinder hydraulic circuit 43 can function as the differential hydraulic circuit as described as "differential output ON" in the first row of FIG. 10, when the telescopic operating lever 95 is placed in the extension side. In this case, when the repeated operation time T1 of the telescopic operating lever 95 is equal to or longer than a predetermined period of time, N seconds (e.g., 10 seconds), the cylinder hydraulic circuit 43 functions as the differential hydraulic circuit, based on the mode setting of the differential changeover switch 111. On the other hand, when the repeated operation time T1 is shorter than the predetermined period of time, N seconds, the setting is "differential output OFF", and therefore the cylinder hydraulic circuit 43 does not function as the differential hydraulic circuit, but functions only as the normal hydraulic circuit. Meanwhile, when the telescopic operating lever 95 is placed in the neutral position P1, the cylinder hydraulic circuit 43 is stopped in any way, and not to be activated as the differential hydraulic circuit ("differential output OFF").

In the case in which the differential changeover switch 111 is not set as the differential hydraulic circuit mode, the cylinder hydraulic circuit 43 cannot function as the differential hydraulic circuit and functions as the normal hydraulic circuit as shown as "normal mode" in the second row of FIG. 10 ("differential output OFF"), regardless of the state of the telescopic operating lever 95 and also of the length of the repeated operation time T1. Meanwhile, when the telescopic operating lever 95 is placed in the neutral position P1, the cylinder hydraulic circuit 43 stops in any way, and not to be activated as the differential hydraulic circuit ("differential output OFF").

As described above, with the present embodiment, when the extension of the telescopic boom 13 using the differential hydraulic circuit was interrupted, and then the telescopic operating lever 95 is turned again to the extension side, the control part 93 adopts the normal hydraulic circuit mode, based on the repeated operation time T1 after the telescopic operating lever 95 is turned back to the neutral position P1 until the telescopic operating lever 95 is turned to the extension side again. Therefore, it is possible to restart the interrupted extension of the telescopic boom 13 during the extension of the telescopic boom 13 using the differential hydraulic circuit mode, and therefore to extend the telescopic boom 13 to a desired length. Moreover, in a case where the telescopic boom 13 is started to be extend, the repeated operation time T1 is usually longer than the predetermined period of time, and thus the control part 93 can adopts the differential hydraulic circuit mode based on the operation of the telescopic operating lever 95. By this means, it is possible to extend the telescopic boom 13 at a high speed. As described above, with the present embodiment, the timer 112 measures the elapsed time as the repeated operation time T1 from the telescopic operating lever 95 being turned back to the neutral position P1 until the telescopic operating lever 95 being turned again to the extension side, and therefore it is possible to adopt an appropriate mode of the cylinder hydraulic circuit 43 depending on the working situation.

In addition, with the present embodiment, the operating part 91 has the differential changeover switch 111 that sets the availability or unavailability of the differential hydraulic circuit mode. Therefore, the operator can set the availability or unavailability of the differential hydraulic circuit mode by using the differential changeover switch 111. By this means, it is possible to choose whether or not the differential hydraulic circuit mode is used. Moreover, when the telescopic operating lever 95 is turned to the extension side again after the extension of the telescopic boom 13 using the differential hydraulic circuit mode was interrupted, the control part 93 adopts the normal hydraulic circuit mode, regardless of the setting of the differential changeover switch 111, based on the repeated operation of the telescopic operating lever 95 in the extension side. As a result, it is possible to restart the extension of the telescopic boom 13 which was interrupted. Therefore, with the present embodiment, the operator can choose and set the usage of the differential hydraulic circuit mode with the differential changeover switch 111, without reducing the convenience for the operator to be able to switch the mode of the cylinder hydraulic circuit 43 by turning the telescopic operating lever 95 to the extension side again during the extension of the telescopic boom 13. In this way, it is possible to set the availability or unavailability of the differential hydraulic circuit mode by using the differential changeover switch 111. Therefore, in a case when a delicate work is required where the telescopic boom 13 has to be extended at a low speed from the beginning, for example, it is possible to prevent the telescopic boom 13 from extending at a high speed with the differential hydraulic circuit. Therefore, it is possible to execute each of crane works at appropriate speeds depending on the working situations.

Although the preferred embodiments have been explained, it is by no means limiting, but it will be appreciated that various modifications and alternations are possible within the scope of the invention.

For example, with the above-described embodiments, in the step ST13 of FIG. 6, the control part 93 confirms the turning back operation of the telescopic operating lever 95 to the neutral position P1. In addition to this, in the step ST13 of FIG. 6, the control part 93 may confirm the repeating operation of the telescopic operating lever 95 to the extension side, for example.

With the above-described embodiments, in the hydraulic circuit 14, the cylinder hydraulic circuit 43 functions as the normal hydraulic circuit and the differential hydraulic circuit. In addition to this, the hydraulic circuit 14 may include the normal hydraulic circuit and the differential hydraulic circuit as separate hydraulic circuits.

With the above-described embodiments, the telescopic cylinder 12 is driven by the hydraulic circuit 14 using hydraulic oil. In addition to this, the telescopic cylinder 12 may be driven by fluid other than hydraulic oil, for example. In this case, the cylinder fluid circuit that applies the fluid force to the telescopic cylinder 12 may function as a normal fluid circuit and a differential fluid circuit.

With the above-described embodiments, the plurality of boom members 12 in the telescopic boom 13 have similar polygonal and cylindrical shapes, and are nested one another in which each of the boom members 21 is inserted and accommodated in the respective outside next boom members 21. In addition to this, the plurality of boom members 21 may have similar U-shaped cross sections, and may be overlaid and nested one another. Moreover, although with the above-described embodiments, all of the boom members 21 are driven by a single telescopic cylinder 12. A plurality of telescopic cylinder 12 may be selectively used to drive the plurality of boom members 21.

The above-described embodiments are examples in which the boom extending and retracting apparatus according to the present invention is applied to the mobile crane 1. In addition to this, the boom extending and retracting apparatus may be applied to a tower crane and a fixed crane apparatus.

The invention claimed is:

1. A boom extending and retracting apparatus of a crane, comprising:

a telescopic boom including a plurality of boom members that can slide with respect to each other;

a telescopic cylinder configured to extend and retract the telescopic boom by sliding the plurality of boom members, the telescopic cylinder including:

a cylinder tube having an internal space filled with fluid; and a piston rod having piston dividing the internal space of the cylinder tube into an extension-side oil chamber and a retraction-side oil chamber, the piston rod moving along an inner surface of the cylinder tube to extend and retract the telescopic cylinder;

a fluid circuit including a normal fluid circuit and a differential fluid circuit, the normal fluid circuit injecting fluid only into the extension-side oil chamber of the telescopic cylinder, and the differential fluid circuit injecting the fluid into the extension-side oil chamber while the fluid in the retraction-side oil chamber can be moved to the extension-side oil chamber;

a controller configured to choose one of the normal fluid circuit and the differential fluid circuit, in order to extend and retract the telescopic boom; and an operating lever turned from a neutral position in order to extend the telescopic boom, wherein after the operating lever is turned to an extension side and the controller starts extending the telescopic boom using the differential fluid circuit, when the operating lever is turned to the extension side again via the neutral position, the controller chooses the normal fluid circuit to extend the telescopic boom using the normal fluid circuit.

2. The boom extending and retracting apparatus of the crane according to claim 1, further comprising a detection member configured to detect an extension amount of the telescopic cylinder, wherein, in a case where the controller determined an interruption of the extension of the telescopic boom based on the detected extension amount by the detection member before the operating lever is turned back to the neutral position, the controller chooses the normal fluid circuit to extend the telescopic boom using the normal fluid circuit.

3. The boom extending and retracting apparatus of the crane according to claim 2, further comprising a timer configured to measure a repeated operation time that has counted from a turned back timing of the operating lever to the neutral position until the repeated operation of the operating lever to the extension side, wherein:

when the repeated operation time is shorter than a predetermined period of time, the controller chooses the normal fluid circuit based on the repeated operation of the operating lever to the extension side, and changes the extension of the telescopic boom with using the normal fluid circuit; and when the repeated operation time is equal to or longer than the predetermined period of time, the controller chooses the differential fluid circuit based on the repeated operation of the operating lever to the extension side, and continues the extension of the telescopic boom with using the differential fluid circuit.

4. The boom extending and retracting apparatus of the crane according to claim 3, further comprising a switch configured to set an availability or unavailability of the differential fluid circuit, wherein, when the operating lever is repeatedly operated to the extension side, the controller chooses the normal fluid circuit regardless of the setting of the switch, and changes the extension of the telescopic boom with using the normal fluid circuit.

5. The boom extending and retracting apparatus of the crane according to claim 4, further comprising a display member configured to display the activated function of the fluid circuit between the normal fluid circuit and the differential fluid circuit.

6. The boom extending and retracting apparatus of the crane according to claim 3, further comprising a display member configured to display the activated function of the fluid circuit between the normal fluid circuit and the differential fluid circuit.

7. The boom extending and retracting apparatus of the crane according to claim 2, further comprising a switch configured to set an availability or unavailability of the differential fluid circuit, wherein, when the operating lever is repeatedly operated to the extension side, the controller chooses the normal fluid circuit regardless of the setting of the switch, and changes the extension of the telescopic boom with using the normal fluid circuit.

8. The boom extending and retracting apparatus of the crane according to claim 2, further comprising a display member configured to display the activated function of the fluid circuit between the normal fluid circuit and the differential fluid circuit.

9. The boom extending and retracting apparatus of the crane according to claim 2, further comprising:

a switch configured to set an availability or unavailability of the differential fluid circuit; and a display member configured to display the activated function of the fluid circuit between the normal fluid circuit and the differential fluid circuit, wherein, when the operating lever is repeatedly operated to the extension side, the controller chooses the normal fluid circuit regardless of the setting of the switch, and changes the extension of the telescopic boom with using the normal fluid circuit.

10. The boom extending and retracting apparatus of the crane according to claim 1, further comprising a timer configured to measure a repeated operation time that has counted from a turned back timing of the operating lever to the neutral position until the repeated operation of the operating lever to the extension side, wherein:

when the repeated operation time is shorter than a predetermined period of time, the controller chooses the normal fluid circuit based on the repeated operation of the operating lever to the extension side, and changes the extension of the telescopic boom with using the normal fluid circuit; and when the repeated operation time is equal to or longer than the predetermined period of time, the controller chooses the differential fluid circuit based on the repeated operation of the operating lever to the extension side, and continues the extension of the telescopic boom with using the differential fluid circuit.

11. The boom extending and retracting apparatus of the crane according to claim 10, further comprising a switch configured to set an availability or unavailability of the differential fluid circuit, wherein, when the operating lever is repeatedly operated to the extension side, the controller chooses the normal fluid circuit regardless of the setting of the switch, and changes the extension of the telescopic boom with using the normal fluid circuit.

12. The boom extending and retracting apparatus of the crane according to claim 10, further comprising a display member configured to display the activated function of the fluid circuit between the normal fluid circuit and the differential fluid circuit.

13. The boom extending and retracting apparatus of the crane according to claim 10, further comprising:

a switch configured to set an availability or unavailability of the differential fluid circuit; and a display member configured to display the activated function of the fluid circuit between the normal fluid circuit and the differential fluid circuit, wherein, when the operating lever is repeatedly operated to the extension side, the controller chooses the normal fluid circuit regardless of the setting of the switch, and changes the extension of the telescopic boom with using the normal fluid circuit.

14. The boom extending and retracting apparatus of the crane according to claim 1, further comprising a switch configured to set an availability or unavailability of the differential fluid circuit, wherein, when the operating lever is repeatedly operated to the extension side, the controller chooses the normal fluid circuit regardless of the setting of the switch, and changes the extension of the telescopic boom with using the normal fluid circuit.

15. The boom extending and retracting apparatus of the crane according to claim 1, further comprising a display member configured to display the activated function of the fluid circuit between the normal fluid circuit and the differential fluid circuit.

16. The boom extending and retracting apparatus of the crane according to claim 1, further comprising:

a switch configured to set an availability or unavailability of the differential fluid circuit; and a display member configured to display the activated function of the fluid circuit between the normal fluid circuit and the differential fluid circuit, wherein, when the operating lever is repeatedly operated to the extension side, the controller chooses the normal fluid circuit regardless of the setting of the switch, and changes the extension of the telescopic boom with using the normal fluid circuit.

* * * * *